US008955585B2

(12) United States Patent
Cavender et al.

(10) Patent No.: US 8,955,585 B2
(45) Date of Patent: Feb. 17, 2015

(54) FORMING INCLUSIONS IN SELECTED AZIMUTHAL ORIENTATIONS FROM A CASING SECTION

(71) Applicant: Halliburton Energy Services, Inc., Houston, TX (US)

(72) Inventors: Travis W. Cavender, Angleton, TX (US); Robert L. Pipkin, Marlow, OK (US); Timothy Hunter, Duncan, OK (US); Roger L. Schultz, Ninnekah, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/624,737

(22) Filed: Sep. 21, 2012

(65) Prior Publication Data

US 2013/0075081 A1 Mar. 28, 2013

(51) Int. Cl.

| | |
|---|---|
| ***E21B 43/10*** | (2006.01) |
| ***E21B 43/16*** | (2006.01) |
| ***E21B 23/04*** | (2006.01) |
| ***E21B 33/127*** | (2006.01) |
| ***E21B 43/08*** | (2006.01) |

(52) U.S. Cl.

CPC ..... *E21B 23/04* (2013.01); *E21B 33/127* (2013.01); *E21B 43/08* (2013.01); *E21B 43/103* (2013.01); *E21B 43/105* (2013.01)

USPC ..... 166/242.1; 166/177.5; 166/308.1

(58) Field of Classification Search

USPC ..... 166/177.5, 308.1, 242.1

See application file for complete search history.

(56) References Cited

U.S. PATENT DOCUMENTS

| | | | |
|---|---|---|---|
| 1,789,993 | A | 1/1931 | Switzer |
| 2,178,554 | A | 11/1939 | Bowie |
| 2,324,819 | A | 6/1941 | Butzbach |

(Continued)

FOREIGN PATENT DOCUMENTS

| | | | |
|---|---|---|---|
| CA | 2114456 | A1 | 7/1995 |
| CA | 2543886 | A1 | 4/2006 |

(Continued)

OTHER PUBLICATIONS

OPTIMUX; "Fluidic Flowmeter: Sensor Technology", informational brochure, 9 pages.

(Continued)

*Primary Examiner* — Robert E Fuller
(74) *Attorney, Agent, or Firm* — Smith IP Services, P.C.

(57) ABSTRACT

A method of forming multiple inclusions into a subterranean formation can include initiating the inclusions into the formation, the inclusions extending outwardly in respective multiple azimuthal orientations from a casing section, and flowing fluid into each of the inclusions individually, thereby extending the inclusions into the formation one at a time. A system for initiating inclusions outwardly into a subterranean formation from a wellbore can include a casing section having multiple flow channels therein, each of the flow channels being in communication with a respective one of multiple openings formed between adjacent pairs of circumferentially extendable longitudinally extending portions of the casing section. Another system can include a casing section, and an injection tool which engages the casing section and selectively directs fluid into each of the inclusions individually, whereby the inclusions are extended into the formation one at a time.

6 Claims, 21 Drawing Sheets

(56) References Cited

U.S. PATENT DOCUMENTS

| | | | |
|---|---|---|---|
| 2,548,360 | A | 4/1951 | Germain |
| 2,634,961 | A | 4/1953 | Ljungstrom |
| 2,642,142 | A | 6/1953 | Clark |
| 2,732,195 | A | 1/1956 | Ljungstrom |
| 2,780,450 | A | 2/1957 | Ljungstrom |
| 2,862,564 | A | 12/1958 | Bostock |
| 2,870,843 | A | 1/1959 | Rodgers, Jr. |
| 3,058,730 | A | 10/1962 | Bays |
| 3,059,909 | A | 10/1962 | Wise |
| 3,062,286 | A | 11/1962 | Wylie |
| 3,071,481 | A | 1/1963 | Beach et al. |
| 3,111,931 | A | 11/1963 | Bodine |
| 3,114,390 | A | 12/1963 | Glättli |
| 3,225,828 | A | 12/1965 | Wisenbaker et al. |
| 3,238,960 | A | 3/1966 | Hatch, Jr. |
| 3,244,189 | A | 4/1966 | Bailey |
| 3,247,861 | A | 4/1966 | Bauer |
| 3,280,913 | A | 10/1966 | Smith |
| 3,284,281 | A | 11/1966 | Thomas |
| 3,301,723 | A | 1/1967 | Chrisp |
| 3,338,317 | A | 8/1967 | Shore |
| 3,349,847 | A | 10/1967 | Smith et al. |
| 3,353,599 | A | 11/1967 | Swift |
| 3,397,713 | A | 8/1968 | Warren |
| 3,407,828 | A | 10/1968 | Jones |
| 3,444,879 | A | 5/1969 | McLeod, Jr. |
| 3,563,462 | A | 2/1971 | Bauer |
| 3,690,380 | A | 9/1972 | Grable |
| 3,695,354 | A | 10/1972 | Dilgren et al. |
| 3,727,688 | A | 4/1973 | Clampitt |
| 3,739,852 | A | 6/1973 | Woods et al. |
| 3,779,915 | A | 12/1973 | Kucera |
| 3,842,907 | A | 10/1974 | Baker et al. |
| 3,888,312 | A | 6/1975 | Tiner et al. |
| 3,913,671 | A | 10/1975 | Redford et al. |
| 3,948,325 | A | 4/1976 | Winston et al. |
| 3,994,340 | A | 11/1976 | Anderson et al. |
| 4,005,750 | A | 2/1977 | Shuck |
| 4,018,293 | A | 4/1977 | Keller |
| 4,052,002 | A | 10/1977 | Stouffer et al. |
| 4,066,127 | A | 1/1978 | Harnsberger |
| 4,085,803 | A | 4/1978 | Butler |
| 4,099,570 | A | 7/1978 | Vandergrift |
| 4,109,722 | A | 8/1978 | Widmyer et al. |
| 4,114,687 | A | 9/1978 | Payton |
| 4,116,275 | A | 9/1978 | Butler et al. |
| 4,119,151 | A | 10/1978 | Smith |
| 4,127,173 | A | 11/1978 | Watkins et al. |
| 4,151,955 | A | 5/1979 | Stouffer |
| 4,271,696 | A | 6/1981 | Wood |
| 4,276,943 | A | 7/1981 | Holmes |
| 4,280,559 | A | 7/1981 | Best |
| 4,291,395 | A | 9/1981 | Holmes |
| 4,311,194 | A | 1/1982 | White |
| 4,323,991 | A | 4/1982 | Holmes et al. |
| 4,344,485 | A | 8/1982 | Butler |
| 4,362,213 | A | 12/1982 | Tabor |
| 4,450,913 | A | 5/1984 | Allen et al. |
| 4,454,916 | A | 6/1984 | Shu |
| 4,474,237 | A | 10/1984 | Shu |
| 4,491,179 | A | 1/1985 | Pirson et al. |
| 4,513,819 | A | 4/1985 | Islip et al. |
| 4,519,454 | A | 5/1985 | McMillen |
| 4,550,614 | A | 11/1985 | Herzl |
| 4,566,536 | A | 1/1986 | Holmes |
| 4,597,441 | A | 7/1986 | Ware et al. |
| 4,598,770 | A | 7/1986 | Shu et al. |
| 4,625,800 | A | 12/1986 | Venkatesan |
| 4,678,037 | A | 7/1987 | Smith |
| 4,696,345 | A | 9/1987 | Hsueh |
| 4,697,642 | A | 10/1987 | Vogel |
| 4,706,751 | A | 11/1987 | Gondouin |
| 4,716,960 | A | 1/1988 | Eastlund et al. |
| 4,834,181 | A | 5/1989 | Uhri et al. |
| 4,838,091 | A | 6/1989 | Markland et al. |
| 4,919,204 | A | 4/1990 | Baker et al. |
| 4,926,941 | A | 5/1990 | Glandt et al. |
| 4,969,827 | A | 11/1990 | Hahs, Jr. |
| 4,976,155 | A | 12/1990 | Challandes |
| 4,977,961 | A | 12/1990 | Avasthi |
| 4,993,490 | A | 2/1991 | Stephens et al. |
| 5,002,431 | A | 3/1991 | Heymans |
| 5,010,964 | A | 4/1991 | Cornette |
| 5,036,918 | A | 8/1991 | Jennings, Jr. et al. |
| 5,046,559 | A | 9/1991 | Glandt |
| 5,054,551 | A | 10/1991 | Duerksen |
| 5,060,287 | A | 10/1991 | Van Egmond |
| 5,060,726 | A | 10/1991 | Glandt et al. |
| 5,063,786 | A | 11/1991 | Sanderson et al. |
| 5,065,818 | A | 11/1991 | Van Egmond |
| 5,103,911 | A | 4/1992 | Heijnen |
| 5,105,886 | A | 4/1992 | Strubhar et al. |
| 5,111,881 | A | 5/1992 | Soliman et al. |
| 5,123,487 | A | 6/1992 | Harris et al. |
| 5,127,173 | A | 7/1992 | Thurston et al. |
| 5,131,471 | A | 7/1992 | Duerksen et al. |
| 5,135,051 | A | 8/1992 | Facteau et al. |
| 5,145,003 | A | 9/1992 | Duerksen |
| 5,148,869 | A | 9/1992 | Sanchez |
| 5,165,438 | A | 11/1992 | Facteau et al. |
| 5,184,678 | A | 2/1993 | Pechkov et al. |
| 5,211,230 | A | 5/1993 | Ostapovich et al. |
| 5,211,714 | A | 5/1993 | Jordan et al. |
| 5,215,146 | A | 6/1993 | Sanchez |
| 5,228,508 | A | 7/1993 | Facteau et al. |
| 5,255,742 | A | 10/1993 | Mikus |
| 5,273,111 | A | 12/1993 | Brannan et al. |
| 5,297,626 | A | 3/1994 | Vinegar et al. |
| 5,318,123 | A | 6/1994 | Venditto et al. |
| 5,325,923 | A | 7/1994 | Surjaatmadja et al. |
| 5,335,724 | A | 8/1994 | Venditto et al. |
| 5,339,695 | A | 8/1994 | Kang et al. |
| 5,339,897 | A | 8/1994 | Leaute |
| 5,372,195 | A | 12/1994 | Swanson et al. |
| 5,386,875 | A | 2/1995 | Venditto et al. |
| 5,392,854 | A | 2/1995 | Vinegar et al. |
| 5,394,941 | A | 3/1995 | Venditto et al. |
| 5,396,957 | A | 3/1995 | Surjaatmadja et al. |
| 5,404,952 | A | 4/1995 | Vinegar et al. |
| 5,407,009 | A | 4/1995 | Butler et al. |
| 5,411,094 | A | 5/1995 | Northrop |
| 5,431,224 | A | 7/1995 | Laali |
| 5,431,225 | A | 7/1995 | Abass et al. |
| 5,472,049 | A | 12/1995 | Chaffee et al. |
| 5,484,016 | A | 1/1996 | Surjaatmadja et al. |
| 5,494,103 | A | 2/1996 | Surjaatmadja et al. |
| 5,505,262 | A | 4/1996 | Cobb |
| 5,533,571 | A | 7/1996 | Surjaatmadja et al. |
| 5,547,023 | A | 8/1996 | McDaniel et al. |
| 5,564,499 | A | 10/1996 | Willis et al. |
| 5,607,016 | A | 3/1997 | Butler |
| 5,626,191 | A | 5/1997 | Greaves et al. |
| 5,667,011 | A | 9/1997 | Gill et al. |
| 5,743,334 | A | 4/1998 | Nelson |
| 5,765,642 | A | 6/1998 | Surjaatmadja |
| 5,771,973 | A | 6/1998 | Jensen et al. |
| 5,824,214 | A | 10/1998 | Paul et al. |
| 5,827,976 | A | 10/1998 | Stouffer et al. |
| 5,829,520 | A | 11/1998 | Johnson |
| 5,862,858 | A | 1/1999 | Wellington et al. |
| 5,871,637 | A | 2/1999 | Brons |
| 5,893,383 | A | 4/1999 | Facteau |
| 5,899,269 | A | 5/1999 | Wellington et al. |
| 5,899,274 | A | 5/1999 | Frauenfeld et al. |
| 5,919,327 | A | 7/1999 | Smith |
| 5,931,230 | A | 8/1999 | Lesage et al. |
| 5,944,446 | A | 8/1999 | Hocking |
| 5,947,183 | A | 9/1999 | Schneider et al. |
| 5,954,946 | A | 9/1999 | Klazinga et al. |
| 5,981,447 | A | 11/1999 | Chang et al. |
| 6,003,599 | A | 12/1999 | Huber et al. |
| 6,015,011 | A | 1/2000 | Hunter |
| 6,023,554 | A | 2/2000 | Vinegar et al. |
| 6,056,057 | A | 5/2000 | Vinegar et al. |

(56) References Cited

U.S. PATENT DOCUMENTS 6,076,046 A 6/2000 Vasudevan
6,079,499 A 6/2000 Mikus et al.
6,116,343 A 9/2000 Van Petegem et al.
6,119,776 A 9/2000 Graham et al.
6,142,229 A 11/2000 Branson, Jr. et al.
6,176,313 B1 1/2001 Coenen et al.
6,216,783 B1 4/2001 Hocking et al.
6,241,019 B1 6/2001 Davidson et al.
6,283,216 B1 9/2001 Ohmer
6,318,464 B1 11/2001 Mokrys
6,330,914 B1 12/2001 Hocking et al.
6,336,502 B1 1/2002 Surjaatmadja et al.
6,360,819 B1 3/2002 Vinegar
6,367,547 B1 4/2002 Towers et al.
6,371,210 B1 4/2002 Bode et al.
6,372,678 B1 4/2002 Youngman et al.
6,405,797 B2 6/2002 Davidson et al.
6,412,557 B1 7/2002 Ayasse et al.
6,443,227 B1 9/2002 Hocking et al.
6,446,727 B1 9/2002 Zemlak et al.
6,508,307 B1 1/2003 Almaguer
6,543,538 B2 4/2003 Tolman et al.
6,591,908 B2 7/2003 Nasr
6,619,394 B2 9/2003 Soliman et al.
6,622,794 B2 9/2003 Zisk, Jr.
6,627,081 B1 9/2003 Hilditch et al.
6,644,412 B2 11/2003 Bode et al.
6,662,874 B2 12/2003 Surjaatmadja et al.
6,691,781 B2 2/2004 Grant et al.
6,708,759 B2 3/2004 Leaute et al.
6,719,048 B1 4/2004 Ramos et al.
6,719,054 B2 4/2004 Cheng et al.
6,722,431 B2 4/2004 Karanikas et al.
6,722,437 B2 4/2004 Vercaemer et al.
6,725,933 B2 4/2004 Middaugh et al.
6,732,800 B2 5/2004 Acock et al.
6,769,486 B2 8/2004 Lim et al.
6,779,607 B2 8/2004 Middaugh et al.
6,782,953 B2 8/2004 Maguire et al.
6,792,720 B2 9/2004 Hocking
6,851,473 B2 2/2005 Davidson
6,883,607 B2 4/2005 Nenninger et al.
6,883,611 B2 4/2005 Smith et al.
6,913,079 B2 7/2005 Tubel
6,948,244 B1 9/2005 Crockett
6,976,507 B1 12/2005 Webb et al.
6,991,037 B2 1/2006 Hocking
7,025,134 B2 4/2006 Byrd et al.
7,044,225 B2 5/2006 Haney et al.
7,055,598 B2 6/2006 Ross et al.
7,059,415 B2 6/2006 Bosma et al.
7,066,284 B2 6/2006 Wylie et al.
7,069,989 B2 7/2006 Marmorshteyn
7,114,560 B2 10/2006 Nguyen et al.
7,185,706 B2 3/2007 Freyer
7,213,650 B2 5/2007 Lehman et al.
7,213,681 B2 5/2007 Birchak et al.
7,216,738 B2 5/2007 Birchak et al.
7,228,908 B2 6/2007 East, Jr. et al.
7,240,728 B2 7/2007 Cook et al.
7,278,484 B2 10/2007 Vella et al.
7,290,606 B2 11/2007 Coronado et al.
7,318,471 B2 1/2008 Rodney et al.
7,404,416 B2 7/2008 Schultz et al.
7,404,441 B2 * 7/2008 Hocking ..... 166/308.1
7,405,998 B2 7/2008 Webb et al.
7,409,999 B2 8/2008 Henriksen et al.
7,412,331 B2 8/2008 Calhoun et al.
7,413,010 B2 8/2008 Blauch et al.
7,537,056 B2 5/2009 MacDougall
7,640,975 B2 1/2010 Cavender et al.
7,640,982 B2 1/2010 Schultz et al.
7,647,966 B2 1/2010 Cavender et al.
7,711,487 B2 5/2010 Surjaatmadja
7,726,403 B2 6/2010 Surjaatmadja
7,740,072 B2 6/2010 Surjaatmadja
7,814,978 B2 10/2010 Steele et al.
7,832,477 B2 11/2010 Cavender et al.
7,918,269 B2 4/2011 Cavender et al.
7,950,456 B2 5/2011 Cavender et al.
8,122,953 B2 2/2012 Cavender et al.
8,151,874 B2 4/2012 Schultz et al.
2002/0189818 A1 12/2002 Metcalfe
2003/0192717 A1 10/2003 Smith et al.
2003/0230408 A1 12/2003 Acock et al.
2004/0011733 A1 1/2004 Bjornsson
2004/0118574 A1 6/2004 Cook et al.
2004/0177951 A1 9/2004 Hoffman et al.
2004/0256099 A1 12/2004 Nguyen et al.
2005/0145387 A1 7/2005 Hocking
2005/0194143 A1 9/2005 Xu et al.
2005/0214147 A1 9/2005 Schultz et al.
2005/0263284 A1 12/2005 Justus
2006/0013427 A1 1/2006 Worman et al.
2006/0039749 A1 2/2006 Gawehn
2006/0104728 A1 5/2006 Erickson et al.
2006/0108442 A1 5/2006 Russell et al.
2006/0131074 A1 6/2006 Calhoun et al.
2006/0144593 A1 7/2006 Reddy
2006/0149478 A1 7/2006 Calhoun et al.
2006/0162923 A1 7/2006 Ware
2007/0045038 A1 3/2007 Han et al.
2007/0199695 A1 8/2007 Hocking
2007/0199697 A1 8/2007 Hocking
2007/0199698 A1 8/2007 Hocking
2007/0199699 A1 8/2007 Hocking
2007/0199700 A1 8/2007 Hocking
2007/0199701 A1 8/2007 Hocking
2007/0199702 A1 8/2007 Hocking
2007/0199704 A1 8/2007 Hocking
2007/0199705 A1 8/2007 Hocking
2007/0199706 A1 8/2007 Hocking
2007/0199707 A1 8/2007 Hocking
2007/0199708 A1 8/2007 Hocking
2007/0199710 A1 8/2007 Hocking
2007/0199711 A1 8/2007 Hocking
2007/0199712 A1 8/2007 Hocking
2007/0199713 A1 8/2007 Hocking
2007/0256828 A1 11/2007 Birchak et al.
2008/0041580 A1 2/2008 Freyer et al.
2008/0041581 A1 2/2008 Richards
2008/0041582 A1 2/2008 Saetre et al.
2008/0041588 A1 2/2008 Richards et al.
2008/0047718 A1 2/2008 Orr et al.
2008/0142219 A1 6/2008 Steele et al.
2008/0149323 A1 6/2008 O'Malley et al.
2008/0283238 A1 11/2008 Richards et al.
2009/0008088 A1 1/2009 Schultz et al.
2009/0008090 A1 1/2009 Schultz et al.
2009/0009297 A1 1/2009 Shinohara et al.
2009/0009333 A1 1/2009 Bhogal et al.
2009/0009336 A1 1/2009 Ishikawa
2009/0009412 A1 1/2009 Warther
2009/0009437 A1 1/2009 Hwang et al.
2009/0009445 A1 1/2009 Lee
2009/0009447 A1 1/2009 Naka et al.
2009/0032251 A1 2/2009 Cavender et al.
2009/0032260 A1 2/2009 Schultz et al.
2009/0032267 A1 2/2009 Cavender et al.
2009/0078427 A1 3/2009 Patel
2009/0078428 A1 3/2009 Ali
2009/0101354 A1 4/2009 Holmes et al.
2009/0133869 A1 5/2009 Clem
2009/0151925 A1 6/2009 Richards et al.
2009/0159282 A1 6/2009 Webb et al.
2009/0178801 A1 7/2009 Nguyen et al.
2009/0218089 A1 9/2009 Steele et al.
2009/0250224 A1 10/2009 Wright et al.
2009/0277639 A1 11/2009 Schultz et al.
2009/0277650 A1 11/2009 Casciaro et al.
2010/0101773 A1 4/2010 Nguyen et al.
2010/0252261 A1 10/2010 Cavender et al.
2011/0042091 A1 2/2011 Dykstra et al.
2011/0042092 A1 2/2011 Fripp et al.

(56) References Cited

U.S. PATENT DOCUMENTS

| | | | |
|---|---|---|---|
| 2011/0094732 | A1 | 4/2011 | Lehman et al. |
| 2012/0160495 | A1 | 6/2012 | Schultz et al. |
| 2012/0167994 | A1 | 7/2012 | Schultz et al. |
| 2012/0168013 | A1 | 7/2012 | Schultz et al. |
| 2012/0168014 | A1 | 7/2012 | Schultz et al. |
| 2012/0168015 | A1 | 7/2012 | Schultz et al. |

FOREIGN PATENT DOCUMENTS

| | | | |
|---|---|---|---|
| EP | 0304988 | B1 | 11/1992 |
| EP | 0834342 | A2 | 4/1998 |
| EP | 1131534 | B1 | 9/2003 |
| EP | 1857633 | A2 | 11/2007 |
| WO | 8100016 | A1 | 1/1981 |
| WO | 0001926 | A1 | 1/2000 |
| WO | 0029716 | A2 | 5/2000 |
| WO | 0214647 | A1 | 2/2002 |
| WO | 03062597 | A1 | 7/2003 |
| WO | 2004092530 | A2 | 10/2004 |
| WO | 2005065334 | A2 | 7/2005 |
| WO | 2005093264 | A1 | 10/2005 |
| WO | 2007100956 | A2 | 9/2007 |
| WO | 2007112175 | A2 | 10/2007 |
| WO | 2007112199 | A2 | 10/2007 |
| WO | 2007117787 | A2 | 10/2007 |
| WO | 2007117810 | A2 | 10/2007 |
| WO | 2007117865 | A2 | 10/2007 |
| WO | 2008024645 | A2 | 2/2008 |
| WO | 2009009336 | A2 | 1/2009 |
| WO | 2009009412 | A2 | 1/2009 |
| WO | 2009009437 | A2 | 1/2009 |
| WO | 2009009445 | A2 | 1/2009 |
| WO | 2009009447 | A2 | 1/2009 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |

OTHER PUBLICATIONS

Office Action issued Nov. 7, 2012 for U.S. Appl. No. 13/411,542, 19 pages.
Search Report issued Apr. 12, 2012 for International Application No. PCT/US11/53403, 5 pages.
Written Opinion issued Apr. 12, 2012 for International Application No. PCT/US11/53403, 12 pages.
Specification and Drawings for U.S. Appl. No. 13/213,259, filed Aug. 19, 2011, 46 pages.
Specification and Drawings for U.S. Appl. No. 13/215,572, filed Aug. 23, 2011, 56 pages.
M.R. Coop, "The Mechanics of Uncemented Carbonate Sands," Geotechnique vol. 40, No. 4, 1990, pp. 607-626.
M.R. Coop and J.H. Atkinson, "The Mechanics of Cemented Carbonate Sands," Geotechnique vol. 43, No. 1, 1993, pp. 53-67.
Wenlu Zhu, et al., "Shear-enhanced Compaction and Permeability Reduction; Triaxial Extension Tests on Porous Sandstone," Mechanics of Materials, 1997, 16 pages.
T. Cuccovillo and M.R. Coop, "Yielding and Pre-failure Deformation of Structured Sands," Geotechnique vol. 47, No. 3, 1997, pp. 491-508.
T.F. Wong and P. Baud, "Mechanical Compaction of Porous Sandstone," Oil and Gas Science and Technology, 1999, pp. 715-727.
Lockner and Stanchits, "Undrained Pore-elastic Response of Sandstones to Deviatoric Stress Change," Porelastic Response of Sandstones, 2002, 30 pages.
Lockner and Beeler, "Stress-Induced Anisotropic Porelasticity Response in Sandstone," Jul. 2003, 13 pages.
Axel Kaselow and Serge Shapiro, "Stress Sensitivity of Elastic Moduli and Electrical Resistivity in Porous Rocks," Journal of Geophysics and Engineering, Feb. 11, 2004, 11 pages.
Halliburton Retrievable Service Tools, Cobra Frac® RR4-EV Packer, 2 pages, undated but created prior to Nov. 13, 2008.
Halliburton Production Optimization, Cobra Frac® Service, Aug. 2005, 2 pages.
Serata Geomechanics Corporation, "Stress/Property Measurements for Geomechanics," www.serata.com, dated 2005-2007, 11 pages.
S.L. Karner, "What Can Granular Media Teach Us about Deformation in Geothermal Systems?" ARMA, 2005, 12 pages.
ISTT, "Trenchless Pipe Replacement," Dec. 11, 2006, 1 page.
ISTT, "Rerounding," Dec. 11, 2006, 1 page.
STAR Frac Completion System brochure, Winter/Spring 2006, 4 pages.
International Search Report and Written Opinion issued Sep. 25, 2008, for International Patent Application Serial No. PCT/US07/87291, 11 pages.
International Search Report and Written Opinion issued Oct. 8, 2008, for International Patent Application Serial No. PCT/US8/70780, 8 pages.
International Search Report and Written Opinion issued Oct. 22, 2008, for International Patent Application Serial No. PCT/US08/70756, 11 pages.
International Search Report and Written Opinion issued Jan. 2, 2009, for International Patent Application Serial No. PCT/US08/70776, 11 pages.
Office Action issued Jan. 26, 2009, for U.S. Appl. No. 11/832,615, 23 pages.
Office Action issued Feb. 2, 2009, for Canadian Patent Application Serial No. 2,596,201, 3 pages.
Office Action issued May 15, 2009, for U.S. Appl. No. 11/610,819, 26 pages.
Office Action issued Jun. 16, 2009, for U.S. Appl. No. 11/832,602, 37 pages.
Office Action issued Jun. 17, 2009, for U.S. Appl. No. 11/832,620, 37 pages.
Office Action issued Sep. 24, 2009, for U.S. Appl. No. 11/966,212, 37 pages.
Office Action issued Sep. 29, 2009, for U.S. Appl. No. 11/610,819, 12 pages.
Office Action issued Jan. 21, 2010, for U.S. Appl. No. 11/610,819, 11 pages.
International Preliminary Report on Patentability issued Feb. 11, 2010, for International Patent Application Serial No. PCT/US08/070756, 10 pages.
International Preliminary Report on Patentability issued Feb. 11, 2010, for International Patent Application Serial No. PCT/US08/070776, 8 pages.
International Preliminary Report on Patentability issued Feb. 11, 2010, for International Patent Application Serial No. PCT/US08/070780, 7 pages.
Invitation to Pay Additional Fees issued May 12, 2010, for International Patent Application Serial No. PCT/US09/63588, 4 pages.
Office Action issued Jul. 21, 2010, for U.S. Appl. No. 12/625,302, 32 pages.
Office Action issued Oct. 1, 2010, for U.S. Appl. No. 12/797,256, 36 pages.
Office Action issued May 5, 2011, for Canadian Patent Application No. 2,686,050, 2 pages.
International Preliminary Report on Patentability issued May 26, 2011, for International Patent Application No. PCT/US09/063588, 11 pages.
Office Action issued Jun. 16, 2011, for U.S. Appl. No. 13/036,090, 9 pages.
Office Action issued Aug. 12, 2011 for U.S. Appl. No. 12/269,995, 20 pages.
English Translation of Russian Official Action issued Feb. 29, 2012 for Russian Patent Application No. 2011123874, 3 pages.
Russian Translation of Official Action issued Feb. 29, 2012 for Russian Patent Application No. 2011123874, 4 pages.
The Lee Company Technical Center, "Technical Hydraulic Handbook" 11th Edition, copyright 1971-2009, 7 pages, Connecticut.
Joseph M. Kirchner, et al., "Design Theory of Fluidic Components", 1975, 9 pages, Academic Press, New York.

(56) References Cited

OTHER PUBLICATIONS

Joseph M. Kirchner, "Fluid Amplifiers", 1996, 6 pages, McGraw-Hill, New York.
Microsoft Corporation, "Fluidics" article, Microsoft Encarta Online Encyclopedia, copyright 1997-2009, 1 page, USA.
Halliburton Drawing No. D00004932, Packer Assembly RR4-EV, Sep. 10, 1999, 2 pages.
G.V. Rotta, et al., "Isotropic Yielding in an Artificially Cemented Soil Cured Under Stress;" Geotechnique vol. 53, No. 53, 2003, pp. 493-501.
Office Action issued Jan. 26, 2011 for U.S. Appl. No. 12/269,995, 66 pages.
Specifications and Drawings for PCT Patent Application No. PCT/US11/53403, filed Sep. 27, 2011, 50 pages.
Canadian Office Action issued Mar. 28, 2012 for CA Patent Application No. 2,686,050, 3 pages.
International Search Report with Written Opinion issued Apr. 12, 2012 for PCT Patent Application No. PCT/US11/053403, 17 pages.
Office Action issued Apr. 19, 2012 for U.S. Appl. No. 13/411,542, 16 pages.
Chinese Office Action issued Jun. 5, 2012 for CN Patent Application No. 200880101404.2, 11 pages.
Office Action issued Jul. 31, 2012 for U.S. Appl. No. 13/411,542, 43 pages.
Office Action issued Aug. 14, 2012 for U.S. Appl. No. 12/983,145, 28 pages.
Office Action issued Sep. 10, 2012 for U.S. Appl. No. 12/792,095, 59 pages.
Specification and drawings for U.S. Appl. No. 13/624,737, filed Sep. 21, 2012, 56 pages.
Office Action issued Oct. 16, 2012 for U.S. Appl. No. 12/983,153, 37 pages.
International Search Report and Written Opinion issued May 2, 2013 for PCT Application No. PCT/GB2011/001758, 10 pages.
International Search Report and Written Opinion issued May 3, 2013 for PCT Application No. PCT/GB2011/001759, 10 pages.
Office Action issued May 16, 2013 for U.S. Appl. No. 13/213,259, 46 pages.
Office Action issued Jun. 4, 2013 for U.S. Appl. No. 12/983,150, 48 pages.
Specification and Drawings for U.S. Appl. No. 10/650,186, filed Aug. 28, 2003, 16 pages.
Apparatus and Method of Inducing Fluidic Oscillation in a Rotating Cleaning Nozzle, ip.com, dated Apr. 24, 2007, 3 pages.
Advisory Action issued Jan. 11, 2013 for U.S. Appl. No. 13/411,542, 5 pages.
Office Action issued Mar. 14, 2013 for U.S. Appl. No. 12/983,145, 23 pages.
International Search Report and Written Opinion issued Feb. 28, 2013 for PCT Application No. PCT/US2012/050727, 12 pages.
International Preliminary Report on Patentability issued Jul. 11, 2013 for International Application No. PCT/GB2011/001760, 7 pages.
Office Action issued Aug. 27, 2013 for U.S. Appl. No. 12/983,145, 29 pages.
Office Action issued Oct. 22, 2013 for U.S. Appl. No. 12/983,150, 31 pages.
Office Action issued Oct. 23, 2013 for U.S. Appl. No. 12/983,144, 38 pages.
Advisory Action issued Jan. 16, 2014 for U.S. Appl. No. 12/983,150, 3 pages.
Office Action issued Jan. 22, 2014 for U.S. Appl. No. 13/411,542, 27 pages.
Office Action issued Jun. 20, 2013 for U.S. Appl. No. 12/983,144, 60 pages.
Office Action issued Jun. 9, 2014 for U.S. Appl. No. 13/215,572, 44 pages.

* cited by examiner

FORMING INCLUSIONS IN SELECTED AZIMUTHAL ORIENTATIONS FROM A CASING SECTION

CROSS-REFERENCE TO RELATED APPLICATION

This application claims the benefit under 35 USC §119 of the filing date of International Application Serial No. PCT/US11/53403, filed 27 Sep. 2011. The entire disclosure of this prior application is incorporated herein by this reference.

BACKGROUND

This disclosure relates generally to equipment utilized and operations performed in conjunction with a subterranean well and, in an example described below, more particularly provides for forming inclusions in selected azimuthal orientations from a casing section.

It is beneficial to be able to form inclusions into subterranean formations. For example, such inclusions might be used to expose more formation surface area to a wellbore, increase permeability of the formation near the wellbore, etc.

Therefore, it will be appreciated that improvements are continually needed in the art of forming inclusions into earth formations.

SUMMARY

In the disclosure below, systems and methods are provided which bring improvements to the art. One example is described below in which individual ones of multiple inclusions can be selectively extended into a formation. Another example is described below in which the inclusions can be isolated from each other while fluid is being flowed into one of the inclusions.

In one aspect, a method of forming multiple inclusions into a subterranean formation is provided to the art by the disclosure below. In one example, the method can include initiating the inclusions into the formation, the inclusions extending outwardly in respective multiple azimuthal orientations from a casing section; and flowing fluid into each of the inclusions individually, thereby extending the inclusions into the formation one at a time.

In another aspect, a system for initiating inclusions outwardly into a subterranean formation from a wellbore is described below. In one example, the system can include a casing section having multiple flow channels therein. Each of the flow channels is in communication with a respective one of multiple openings formed between adjacent pairs of circumferentially extendable longitudinally extending portions of the casing section.

In another aspect, a system for forming multiple inclusions into a subterranean formation can include a casing section, and an injection tool which engages the casing section and selectively directs fluid into each of the inclusions individually, whereby the inclusions are extended into the formation one at a time.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
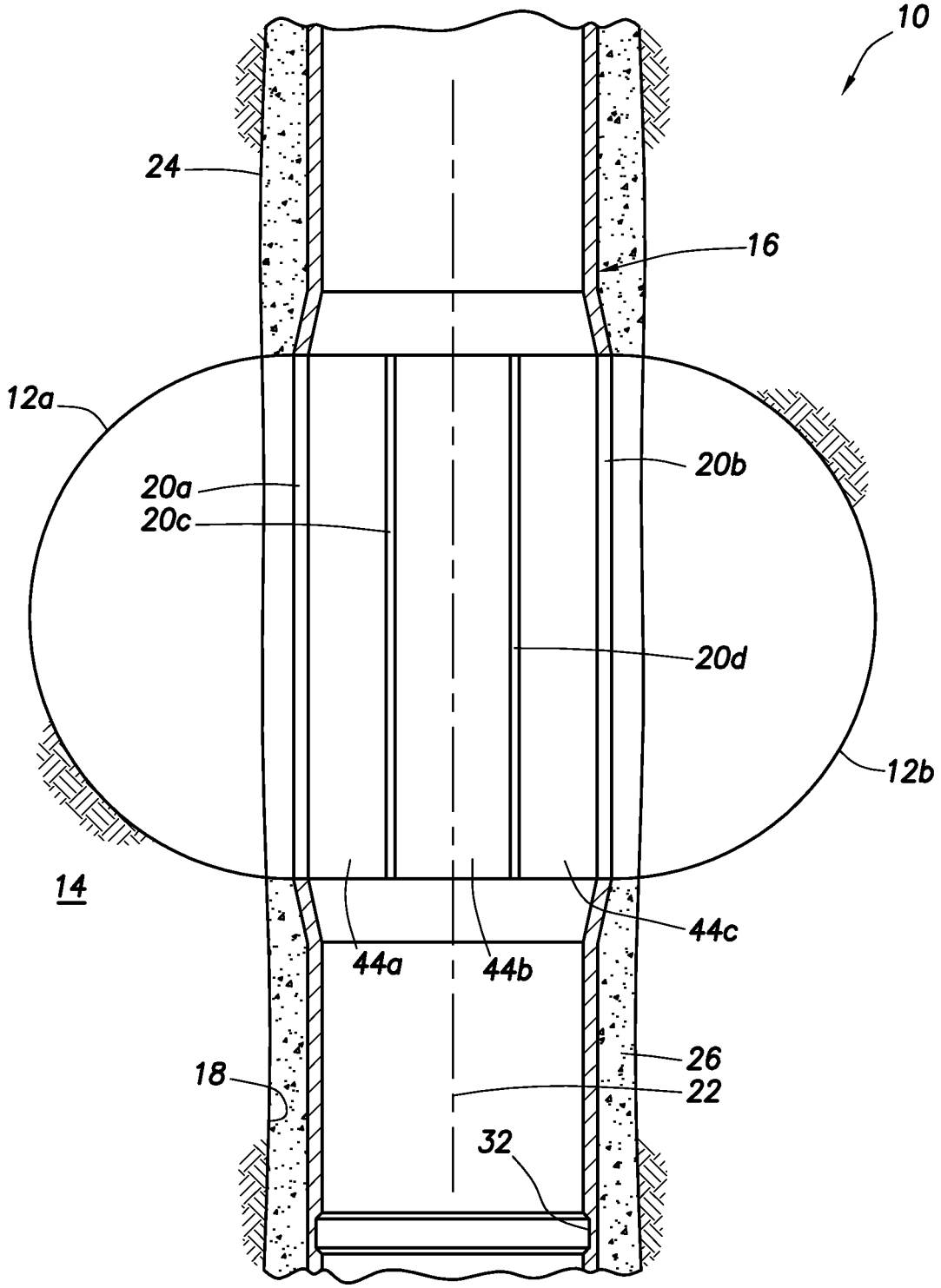
FIG. 1 is a representative partially cross-sectional view of a well system and associated method which can embody principles of this disclosure.

Representatively illustrated in FIG. 1 is a system 10 and associated method for extending multiple inclusions 12 (only two of which (inclusions 12*a,b*) are visible in FIG. 1) outwardly into a subterranean formation 14. The system 10 and method can embody principles of this disclosure, but it should be clearly understood that those principles are not limited in any manner to the details of the system and method described herein and/or depicted in the drawings, since the system and method represent merely one example of how those principles could be applied in actual practice.

In the system 10 as depicted in FIG. 1, a casing section 16 is cemented in a wellbore 18 which penetrates the formation 14. The inclusions 12*a,b* extend outwardly through longitudinally extending (e.g., extending generally parallel to a longitudinal axis 22 of the casing section 16) openings 20*a-d* formed through a side wall of the casing section.

Note that, in the FIG. 1 example, each of the inclusions 12*a,b* is generally planar, and the inclusions viewed in FIG. 1 are in a same plane. However, in other examples, the inclusions may not necessarily be planar, and multiple inclusions may not be in the same plane.

Preferably, the inclusions 12*a,b* are areas of increased permeability in the formation 14.

The formation 14 may be relatively unconsolidated, such that the formation yields and tears, rather than "fractures" when the inclusions 12*a,b* are propagated into the formation. Thus, the inclusions 12*a,b* may or may not comprise fractures, depending on the characteristics of the formation 14.

Although only two of the inclusions 12*a,b* and four of the openings 20*a-d* are visible in FIG. 1, in this example there are actually six each of the inclusions and openings, with each inclusion being associated with a corresponding one of the openings, equally azimuthally (with respect to the axis 22) spaced apart. However, in other examples, other numbers of openings and inclusions, and other azimuthal spacings between the openings and inclusions, may be used if desired. For example, each of the openings 20*a-d* could be subdivided into multiple apertures, more than one aperture could be associated with each inclusion, more than one inclusion could be associated with each aperture, etc.

As depicted in FIG. 1, the casing section 16 has been expanded radially outward, thereby initiating the inclusions 12*a,b*. In this example, the casing section 16 is expanded by increasing its circumference, thereby widening the openings 20*a-d* (which may or may not exist prior to the casing section being expanded—such expansion could cause the openings to be formed through the casing section side wall).

This increase in the circumference of the casing section 16 causes cement 24 in an annulus 26 formed radially between the casing section and the wellbore 18 to part at each of the widening openings 20*a-d*. Thus, the initiation of the inclusions 12*a,b* preferably begins with the expansion of the casing section 16.

At this point, the inclusions 12*a,b* also preferably extend somewhat radially outward into the formation 14, due to dilation of the formation about the wellbore 18. Note that compressive stress in the formation 14 circumferentially about the wellbore 18 is preferably reduced, and compressive stress in the formation directed radial to the wellbore is increased, due to expansion of the casing section 16, thereby desirably influencing the inclusions 12*a,b* to propagate in a relatively consistent radial direction relative to the wellbore.

Note that the term "casing" as used herein indicates a protective wellbore lining. Casing can be comprised of tubular materials known to those skilled in the art as tubing, liner or casing. Casing can be segmented or continuous, installed in tubular form or formed in situ. Casing can be made of steel, other metals or alloys, plastics, composites or other materials. Casing can have conductors, optical waveguides or other types of lines interior to, external to or within a sidewall of the casing. Casing is not necessarily cemented in a wellbore.

Furthermore, note that the term "cement" as used herein indicates a hardenable material which supports an inner surface of a wellbore and, if the wellbore is cased, seals off an annulus formed radially between the wellbore and the casing, or between casings. Cement is not necessarily cementitious, since other types of materials (e.g., elastomers, epoxies, foamed materials, hardenable gels, etc.) can be used to support a wellbore or seal off an annulus.

Figure 2:
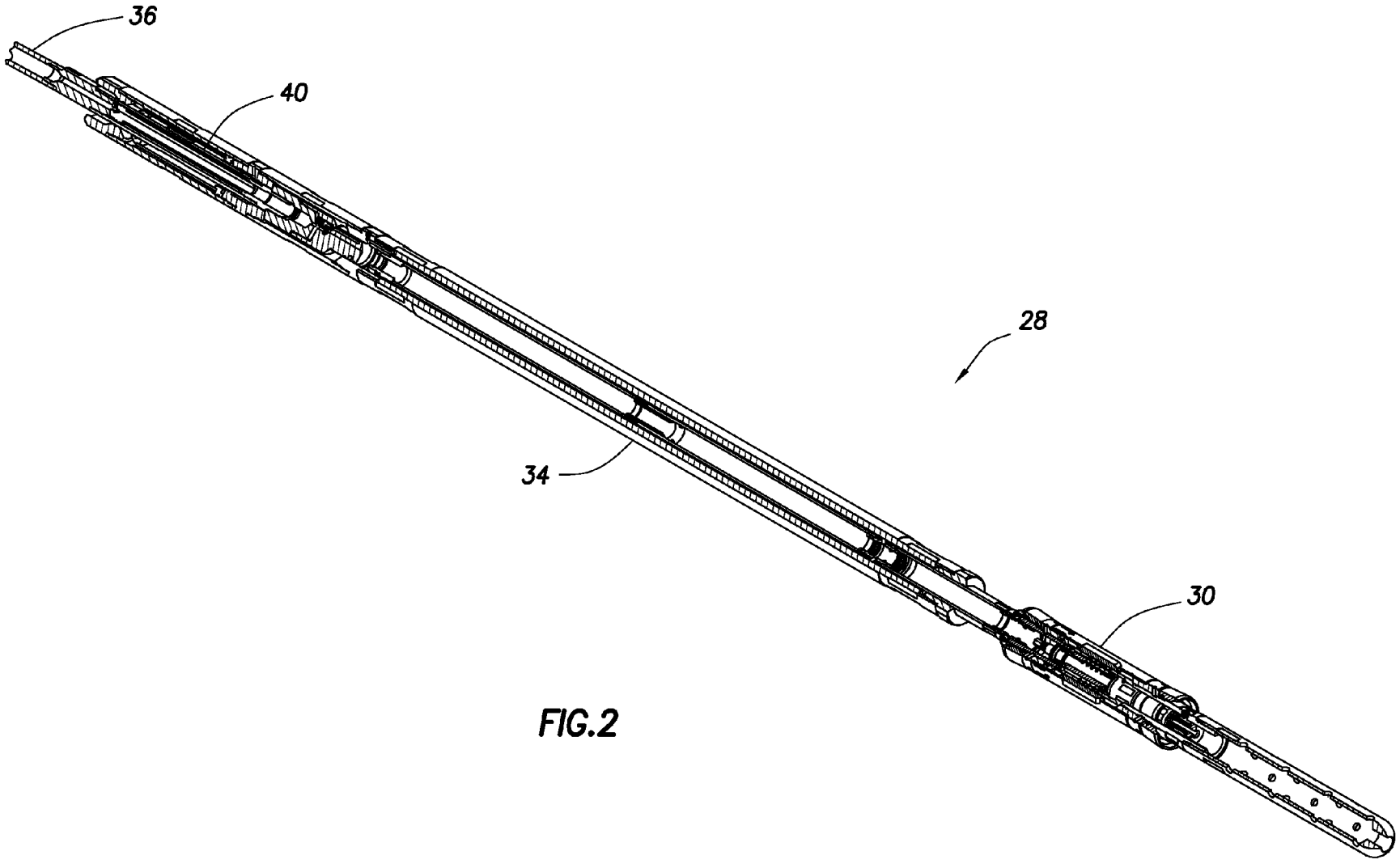
FIG. 2 is a representative sectioned perspective view of an expansion tool which may be used in the system and method.

Referring additionally now to FIG. 2, an expansion tool 28 which may be used to expand the casing section 16 is representatively illustrated. However, the expansion tool 28 could be used to expand other casing sections, or to accomplish other purposes, in keeping with the scope of this disclosure.

In the example depicted in FIG. 2, the expansion tool 28 includes a latch 30 for cooperatively engaging a latch profile 32 (see FIG. 1). The latch profile 32 could be part of the casing section 16, or could be formed in a separate component attached a known distance from the casing section, on either side of the casing section, etc.

When the latch 30 is properly engaged with the latch profile 32, a tubular inflatable packer or bladder 34 is expanded radially outward into contact with the casing section 16. Increasing pressure applied to an interior of the bladder 34 will cause the casing section 16 to be biased radially outward, thereby widening the openings 20*a-d* and initiating the inclusions 12*a,b*.

Available pressure to inflate the bladder 34 and expand the casing section 16 can be provided by a pressure intensifier 40 in the expansion tool 28. In this example, the pressure intensifier 40 operates by alternately increasing and decreasing pressure in a tubular string 36 attached to the expansion tool 28 (and extending to a remote location, such as the earth's surface). However, other types of pressure intensifiers (e.g., which could respond to reciprocation or rotation of the tubular string 36, etc.) may be used, if desired.

The bladder 34 is preferably robust and capable of being inflated to about 10,000 psi (~69 MPa) to radially outwardly expand the casing section 16. In the FIG. 2 example, the casing section 16 is expanded at one time (e.g., with the openings 20*a-d* widening between longitudinal portions 44*a-c* of the casing section, see FIG. 1) as the bladder 34 is inflated. In other examples, the openings 20*a-d* could be selectively widened, widened one at a time, etc., and remain within the scope of this disclosure.

The expansion tool 28 is described in further detail below in relation to FIGS. 9A-F. Further details of the latch 30 are shown in FIG. 10E.

Figure 3:
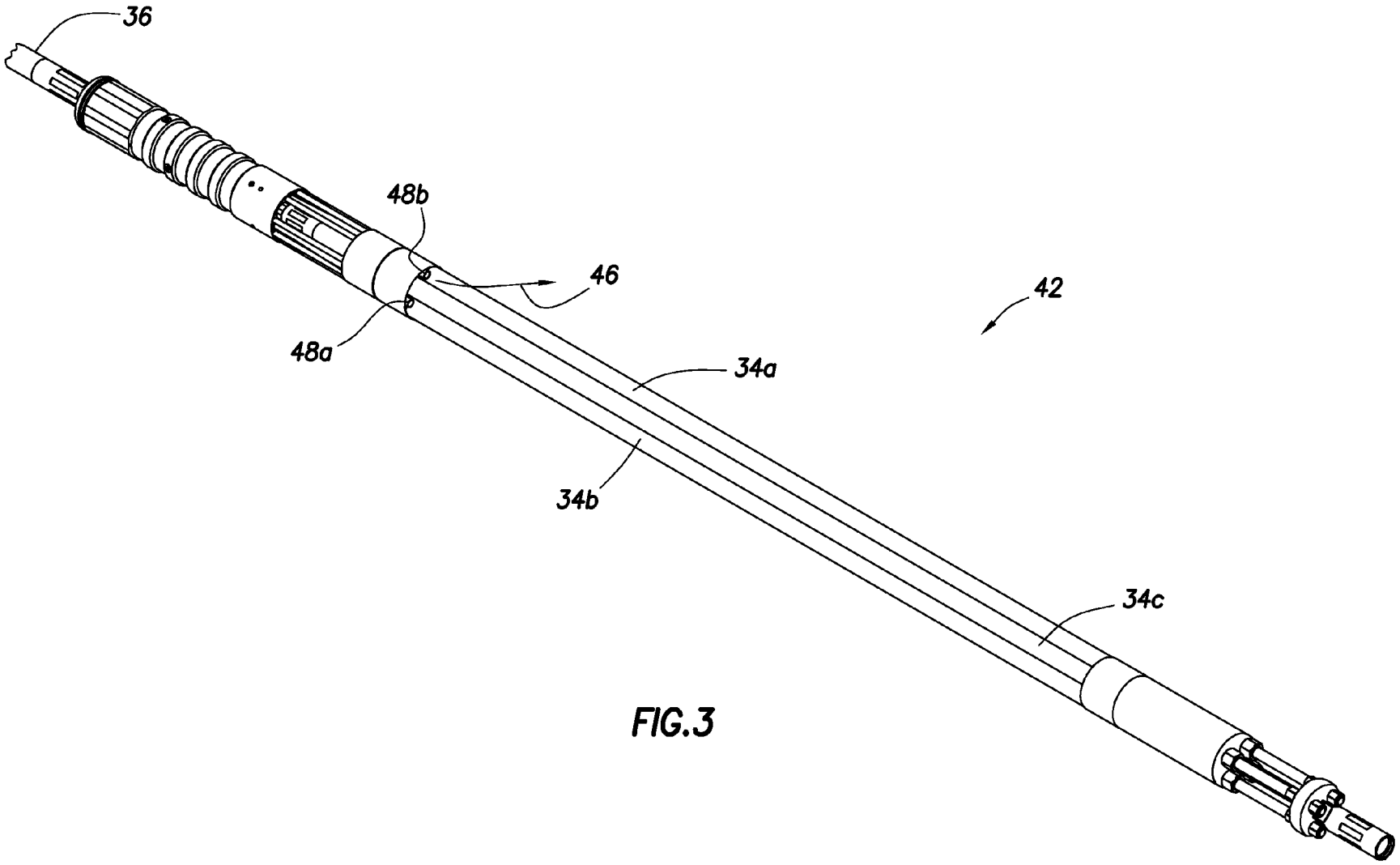
FIG. 3 is a representative perspective view of an injection tool which may be used with in the system and method.

Referring additionally now to FIG. 3, an injection tool 42 which may be used to selectively and individually propagate the inclusions 12*a,b* outward into the formation 14 is representatively illustrated. The injection tool 42 can be used in systems and methods other than the system 10 and method of FIG. 1, in keeping with the scope of this disclosure.

In the example of FIG. 3, the injection tool 42 includes multiple longitudinally extending tubular bladders 34*a-c*. When appropriately positioned in the expanded casing section 16 (e.g., using a latch 30 attached to the injection tool 42 and engaged with the profile 32, etc.), each of the bladders 34*a-c* is positioned between an adjacent pair of the openings 20*a-d*. Although the FIG. 3 example utilizes four of the bladders 34*a-c* (one of the bladders not being visible in FIG. 3), when configured for use in the casing section 16 of FIG. 1 the injection tool 42 could include six of the bladders.

When the bladders 34*a-c* are inflated (e.g., by applying pressure to the tubular string 36 connected to the injection tool 42, etc.), the openings 20*a-d* are isolated from each other in the casing section 16. Fluid 46 can then be selectively discharged from each of multiple conduits 48*a,b* individually, to thereby propagate the inclusions 12*a,b* individually outward into the formation 14.

This individual control over flow of the fluid 46 into each inclusion 12*a,b* is beneficial, in part, because it allows an operator to control how each inclusion is formed, how far the inclusion extends into the formation 14, how quickly the fluid is flowed into each inclusion, etc. This, in turn, allows the operator to individually optimize the formation of each of the inclusions 12*a,b*.

Figure 4:
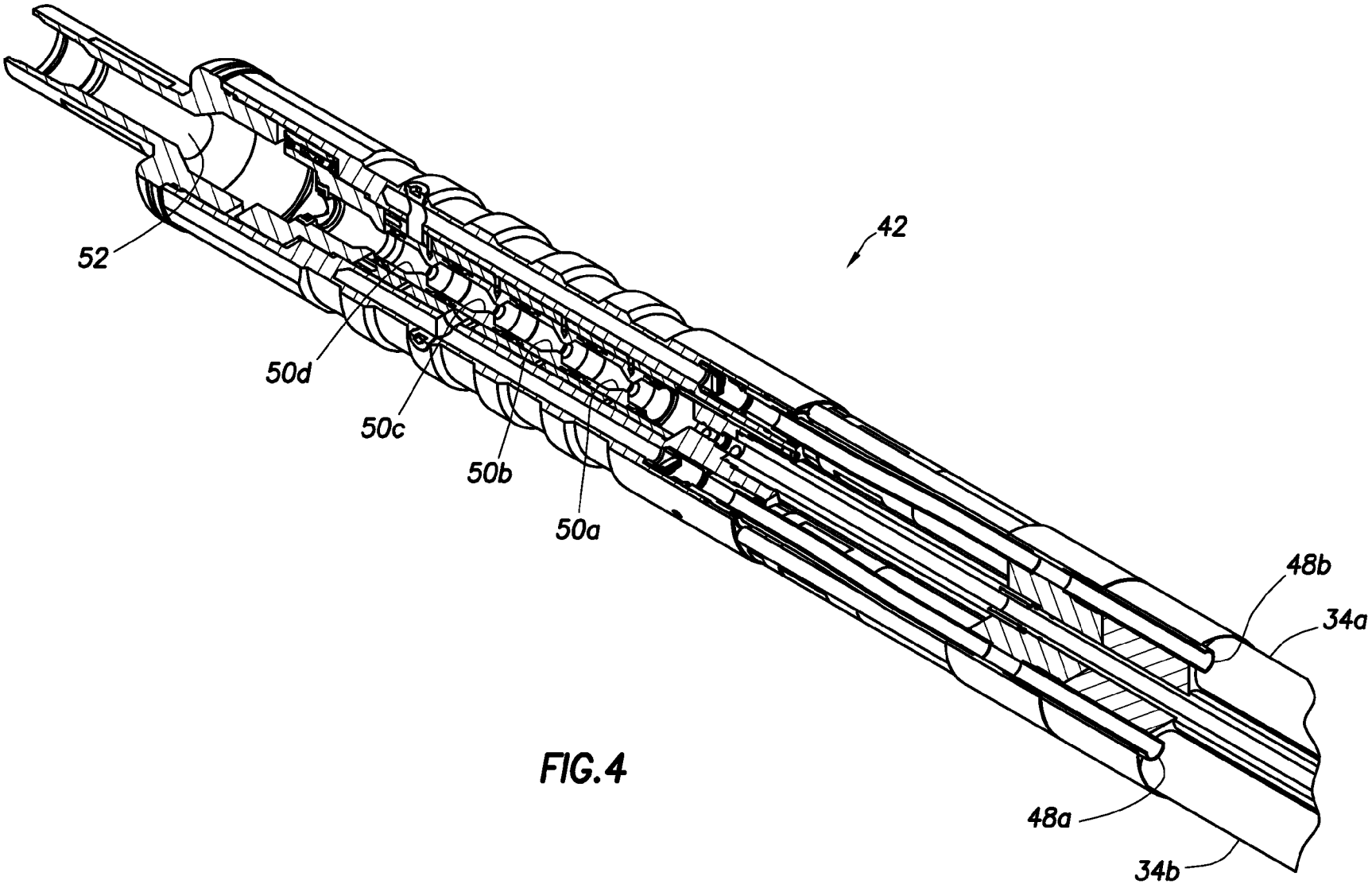
FIG. 4 is an enlarged scale representative sectioned perspective view of an upper portion of the injection tool of FIG. 3.
Figure 5:
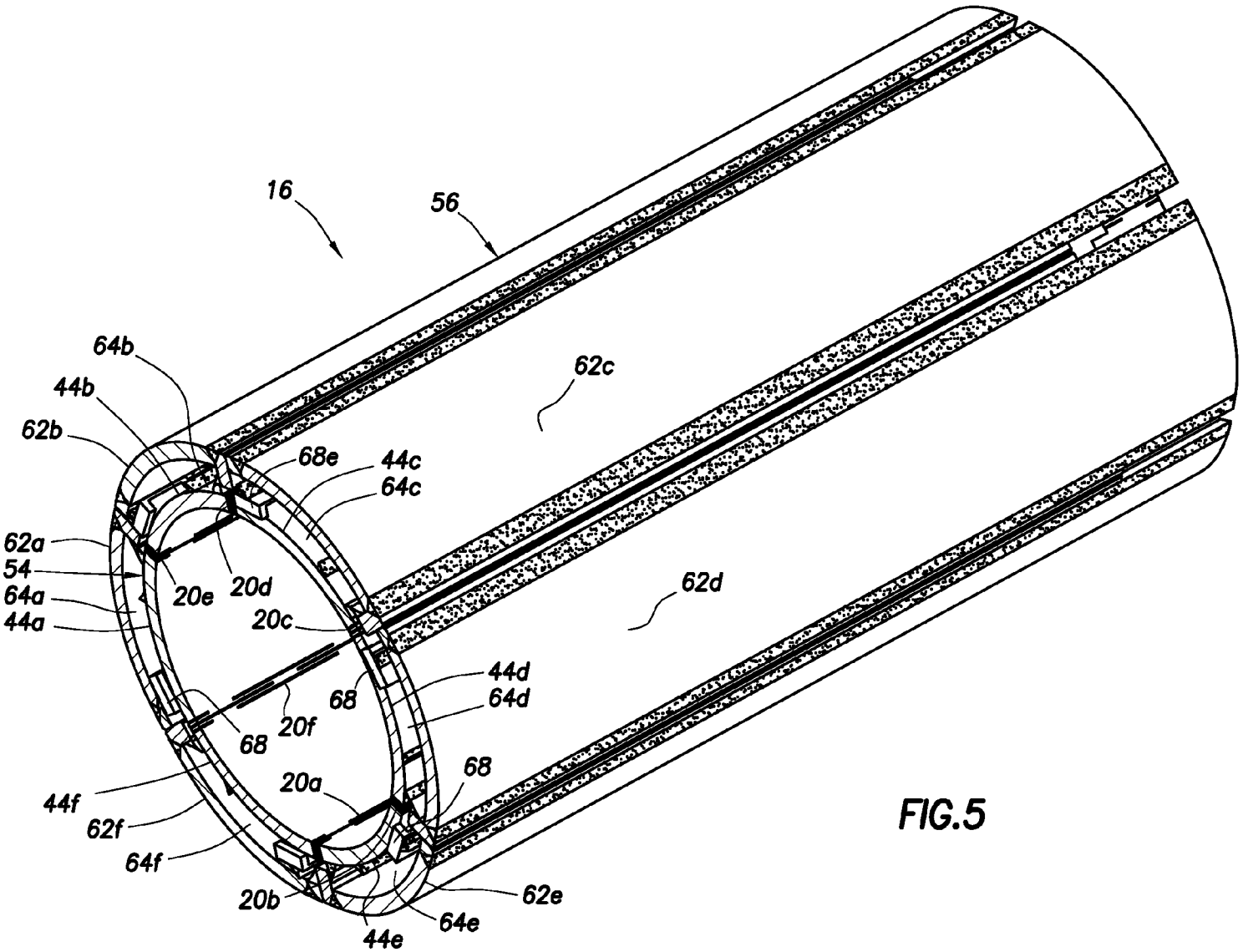
FIGS. 5 & 6 are representative perspective and cross-sectional views of a casing section which can embody principles of this disclosure, the casing section being in an unexpanded configuration.
Figure 6:
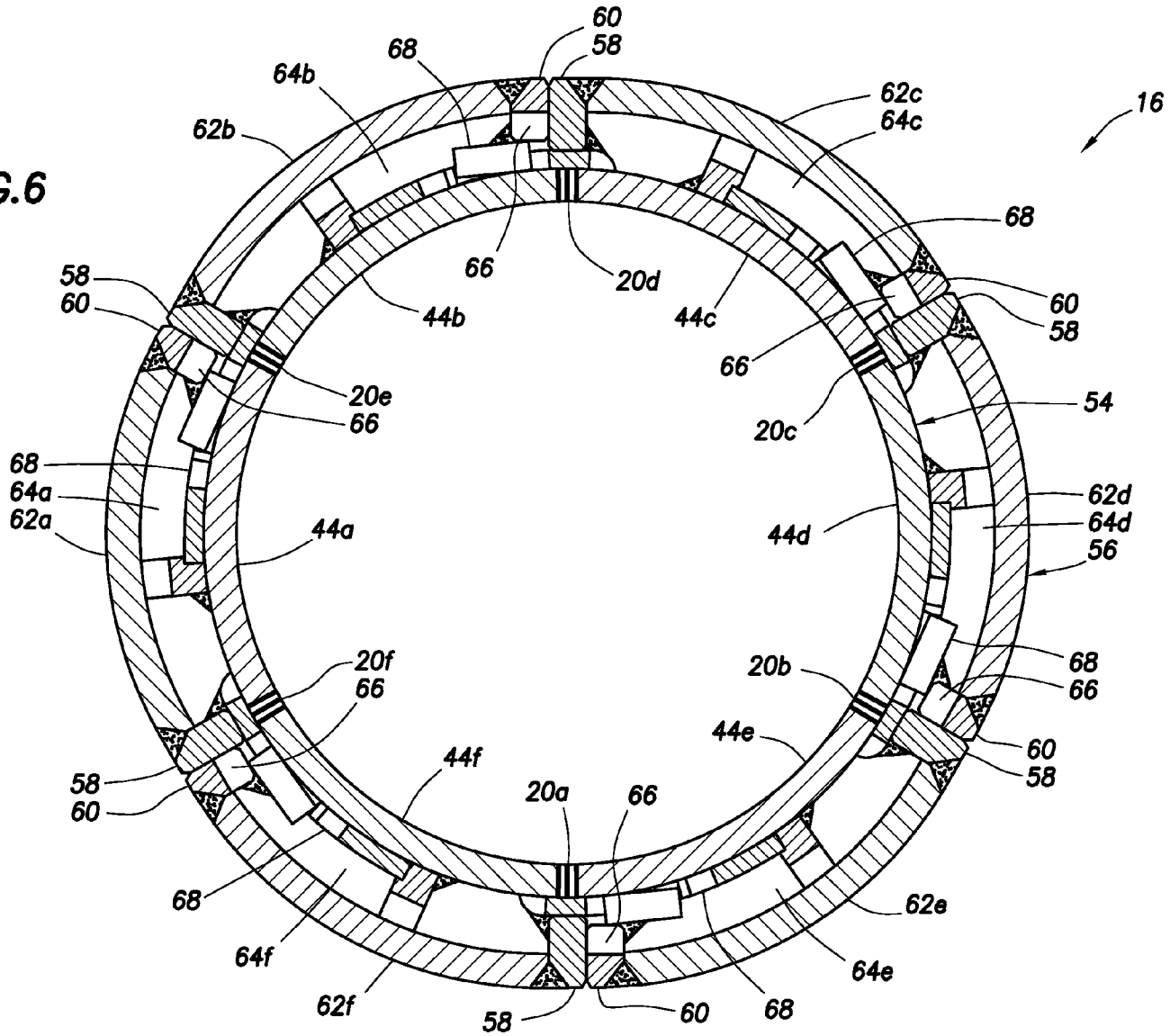
Figure 7:
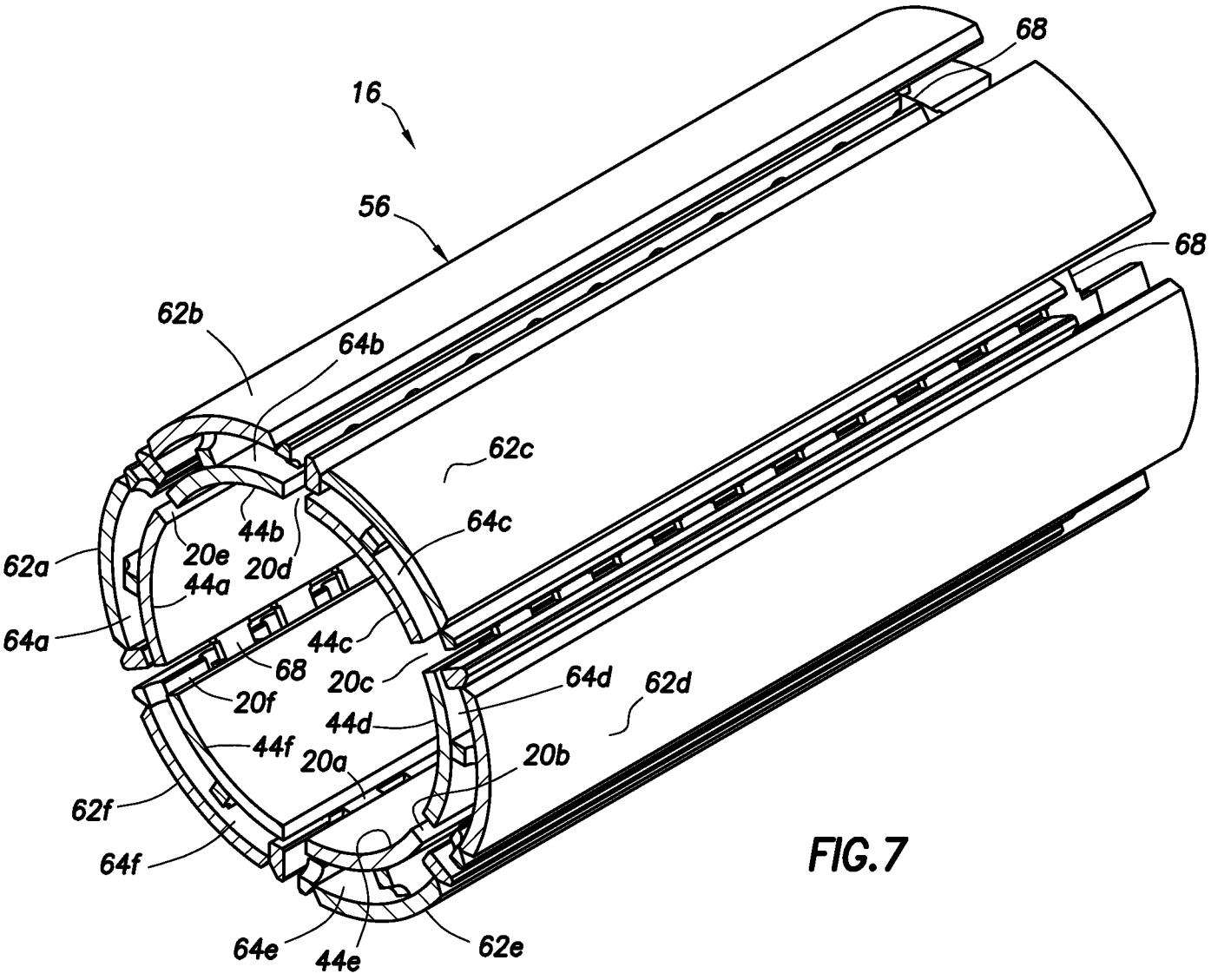
FIGS. 7 & 8 are representative perspective and cross-sectional views of the casing section in an expanded configuration.
Figure 8:
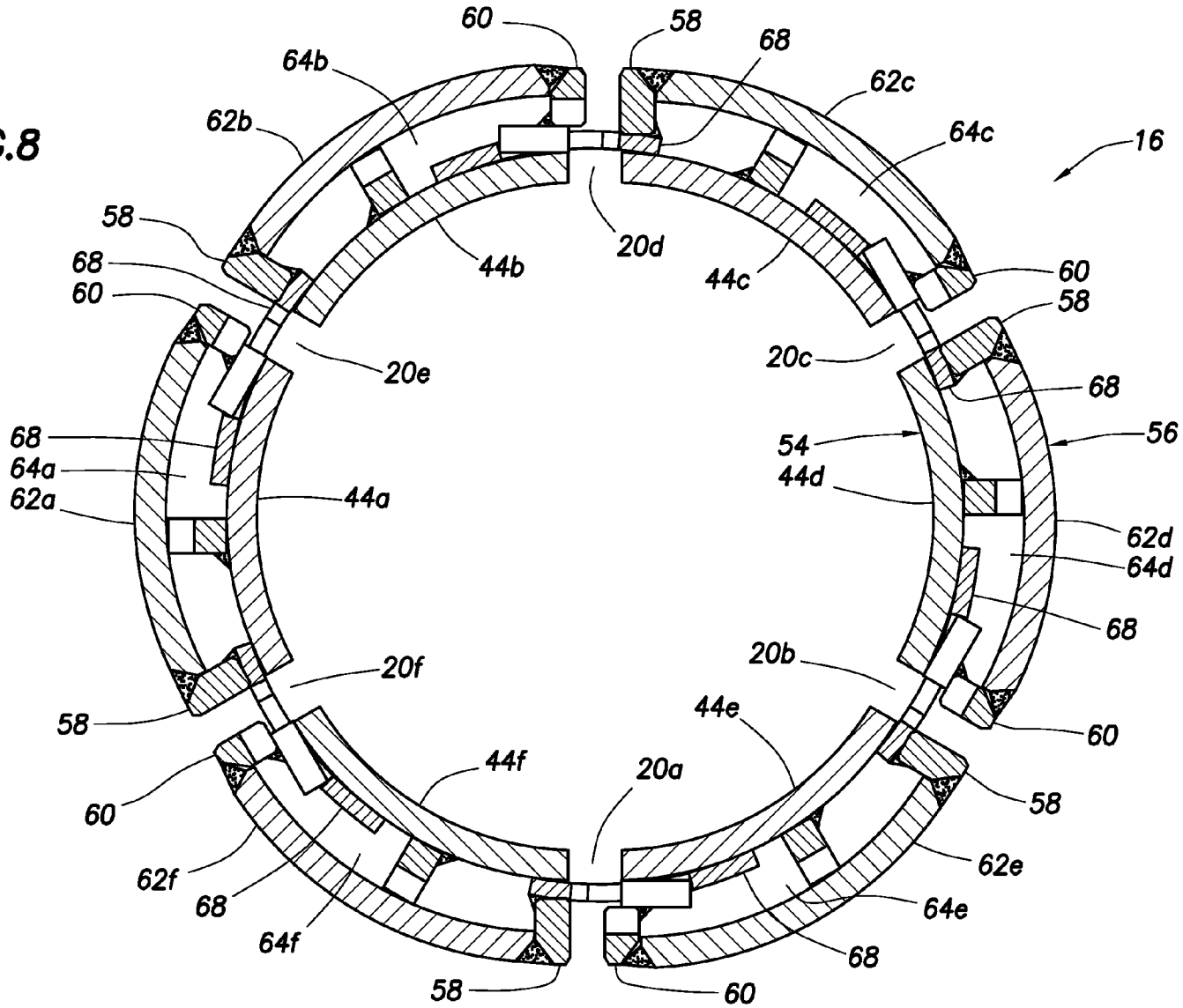

In FIG. 4, a sectioned upper portion of the injection tool 42 is representatively illustrated. In this view, it may be seen that control over which of the conduits 48*a,b* is selected for flow of the fluid 46 is provided by multiple, successively smaller diameter, seats 50*a-d*.

Corresponding successively smaller diameter plugs (e.g., balls, darts, etc., not shown) are dropped into a flow passage 52 extending longitudinally through the tool 42. After each plug is dropped, the plug sealingly engages one of the seats 50*a-d*, and pressure is applied to the passage 52 (e.g., via the tubular string 36) to release a retainer (such as, a shear pin, snap ring, etc.) and allow the seat to displace and expose a port placing the passage above the plug in communication with the corresponding conduit 48*a,b* (and preventing communication between the passage and any conduit previously in communication with the passage). In this manner, each of the conduits 48*a,b* (a total of four of them in this example) is selectively and individually placed in communication with the passage 52 for flowing the fluid 46 into the inclusions 12*a,b* one at a time.

Referring additionally now to FIGS. 5-8, one example of the casing section 16 is representatively illustrated in unexpanded (FIGS. 5 & 6) and expanded (FIGS. 7 & 8) configurations. The casing section 16 of FIGS. 5-8 may be used in the system 10 and method of FIG. 1, or it may be used in other systems and methods, in keeping with the scope of this disclosure.

In FIGS. 5-8, it may be seen that the openings 20*a-f* each comprises multiple longitudinally overlapping slits. In this example, the slits can be laser cut through a sidewall of an inner tubular shell 54 of the casing section 16. The slits can be temporarily plugged, if desired, to prevent flow through the slits until the casing section 16 is expanded.

In other examples, the openings 20*a-f* could be otherwise formed, could exist before or only after the casing section 16 is expanded, could be provided in an outer shell 56 of the casing section (e.g., instead of, or in addition to those in the inner shell 54), etc. Thus, any manner of forming the openings 20*a-f* may be used, in keeping with the scope of this disclosure.

Two bulkheads 58, 60 separate each adjacent pair of longitudinally extending portions 62*a-f* of the outer shell 56. Longitudinally extending flow channels 64*a-f* are, thus, defined radially between the respective inner and outer shell portions 44*a-f* and 62*a-f*, and circumferentially between the respective bulkheads 58, 60 to either circumferential side of the shell portions 44*a-f* and 62*a-f*.

The bulkheads may be sealed to each other (e.g., with sealant, small weld, etc.) to prevent fluid communication between the bulkheads during installation and cementing of the casing section 16, if desired.

Each of the bulkheads 60 has apertures 66 therein, permitting communication between the corresponding one of the channels 64*a-f* and the corresponding one of the openings 20*a-f* (at least in the expanded configuration). Thus, each of the channels 64*a-f* is in communication with a corresponding one of the openings 20*a-f*, and with a corresponding one of the inclusions 12*a,b*, at least in the expanded configuration of the casing section 16. In some examples, the channels 64*a-f* may continually be in communication with the respective openings 20*a-f* and/or inclusions 12*a,b*.

Preferably, the casing section 16 includes spacing limiters 68 which limit the widening of each opening 20*a-f*. The limiters 68 also preferably prevent subsequent narrowing of the openings 20*a-f*. However, use of the limiters 68 is not necessary in keeping with the principles of this disclosure.

Note that it is not necessary for the casing section 16 construction of FIGS. 5-8 to be used with the expansion tool 28 and injection tool 42 of FIGS. 2-4. Instead, a single-walled casing section with multiple longitudinal openings 20*a-f* could be used (as depicted in FIG. 1). Each of the conduits 48*a,b* can communicate with a corresponding one of the openings 20*a-f* (each opening being positioned between two of the bladders 34*a-c*) to selectively inject the fluid directly into the formation 14 (e.g., without use of the channels 64*a-f*, bulkheads 58, 60, etc.). However, the limiters 68 could still be used with the single-walled casing section 16 to control the extent of widening of the openings 20*a-f*.

Referring additionally now to FIGS. 9A-F, enlarged scale sectioned views of one example of the expansion tool 28 is representatively illustrated. In this example, the expansion tool 28 includes the pressure intensifier 40, the latch 30 and the inflatable bladder 34 of FIG. 2.

Figure 9A:
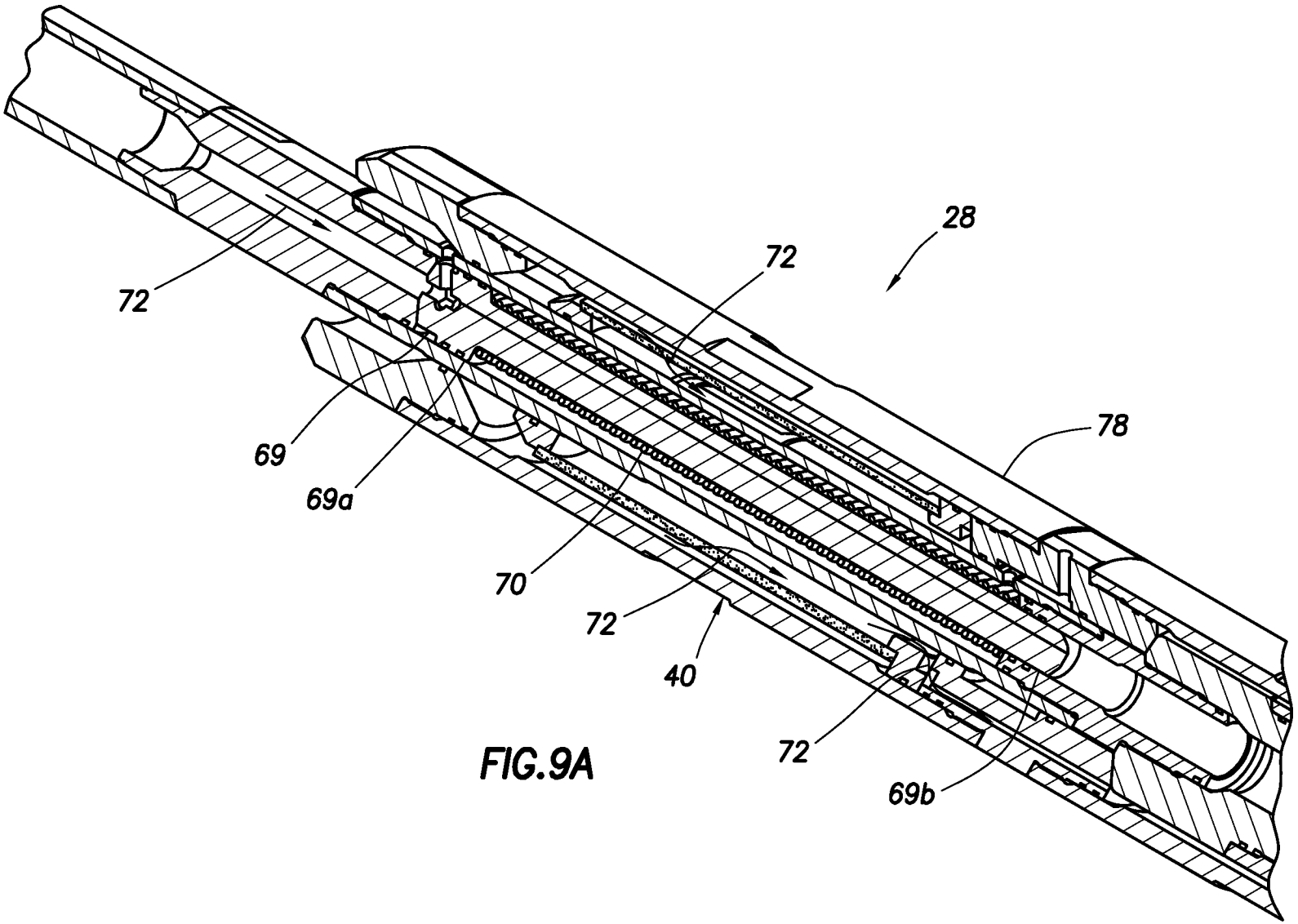
FIGS. 9A-F are enlarged scale representative sectioned perspective views of the expansion tool.
Figure 9B:
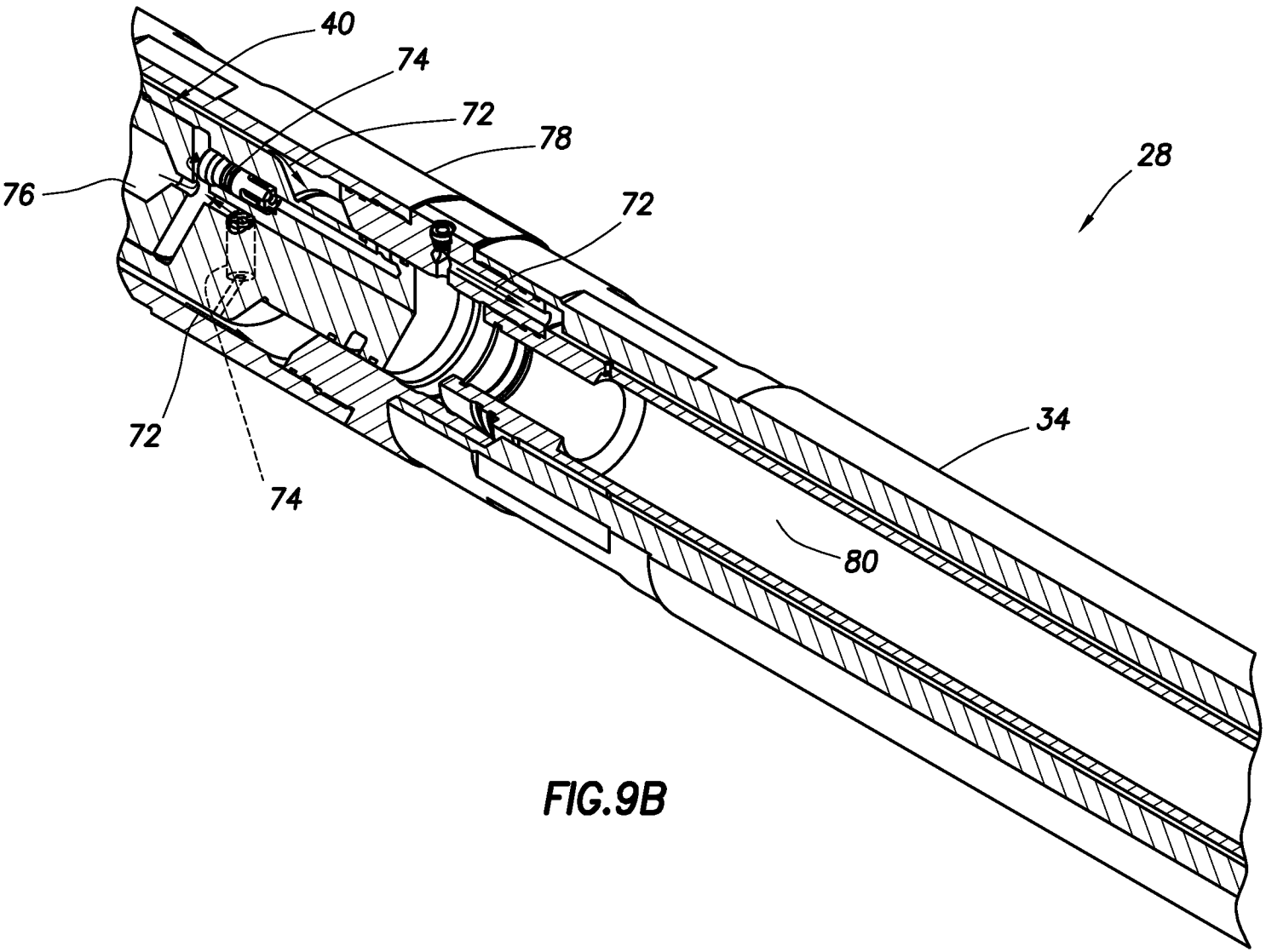
Figure 9C:
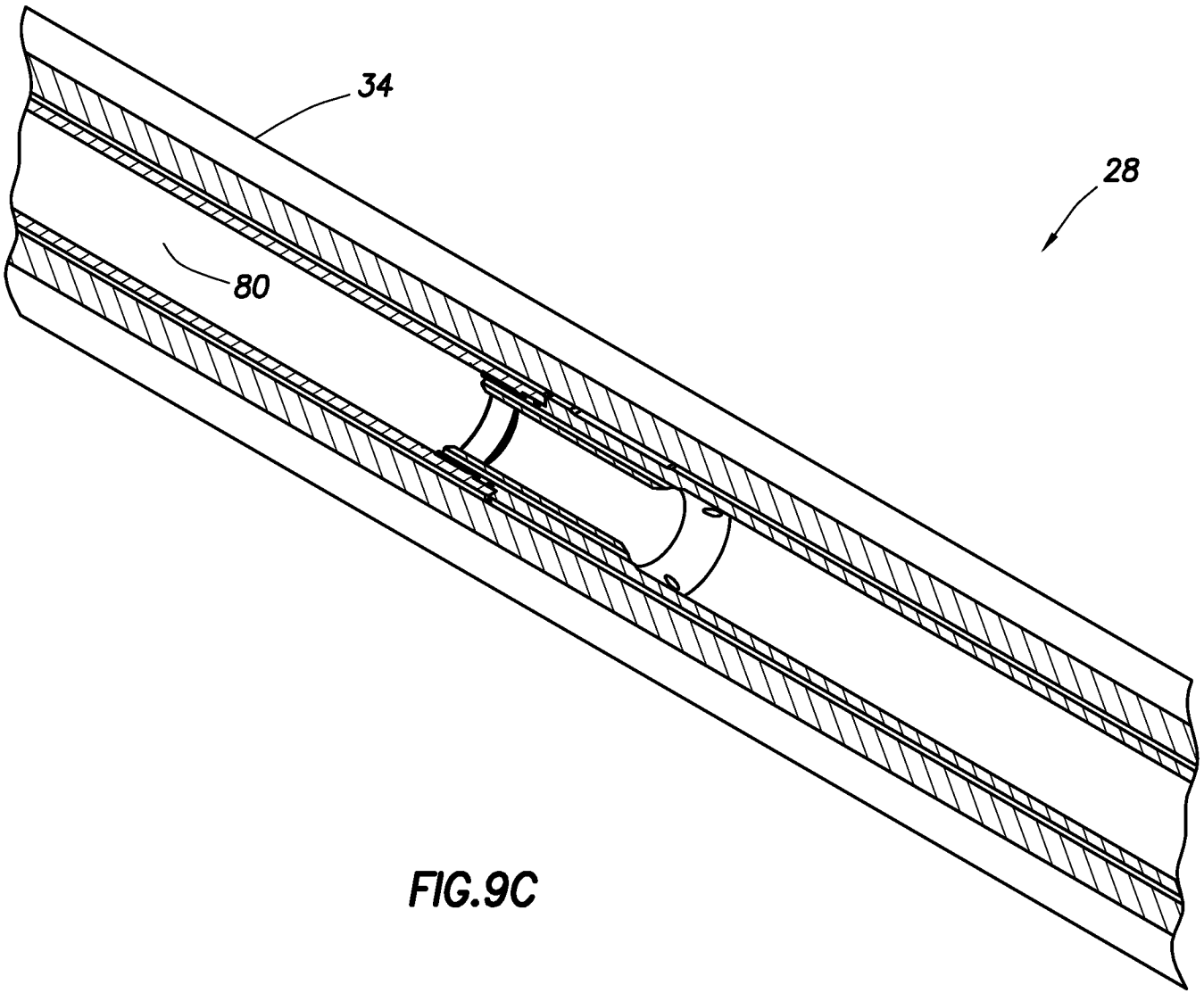
Figure 9D:
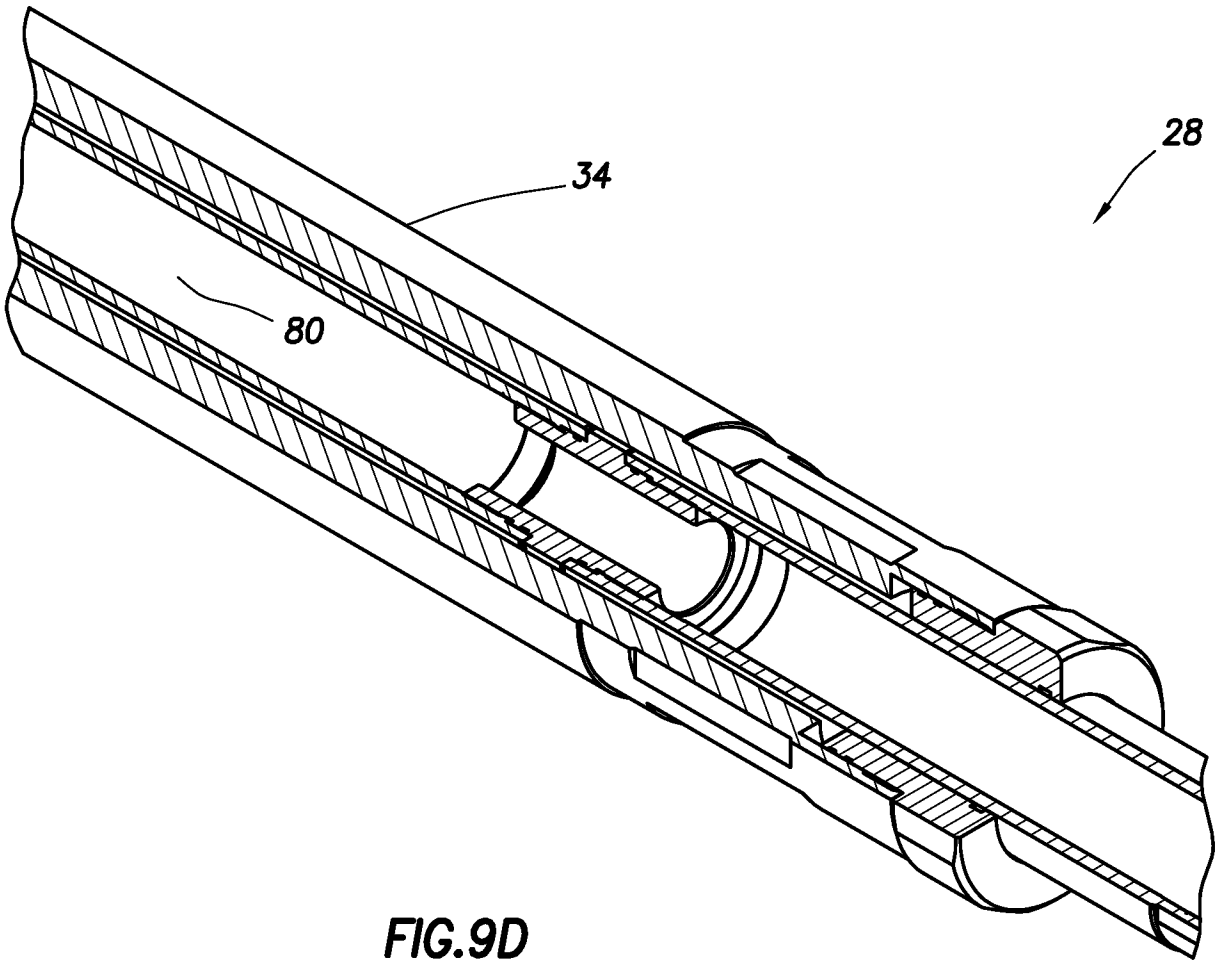
Figure 9E:
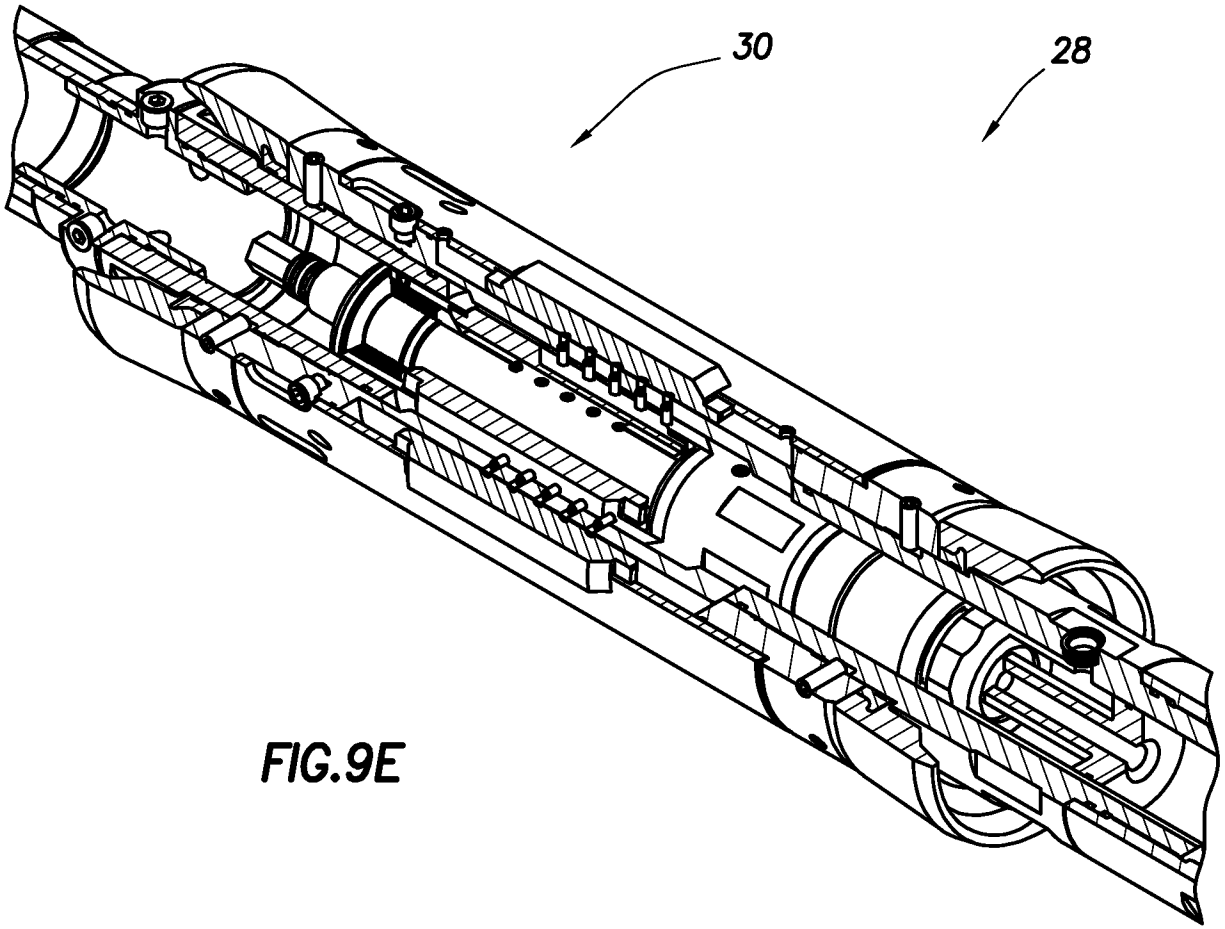
Figure 9F:
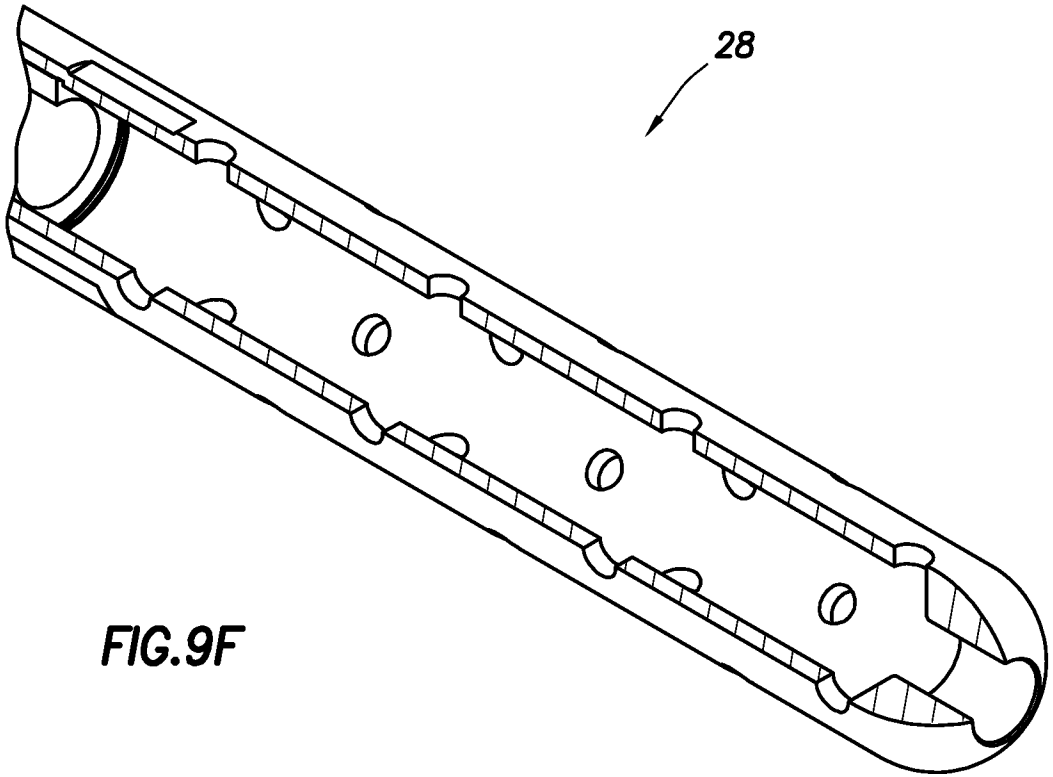
Figure 10A:
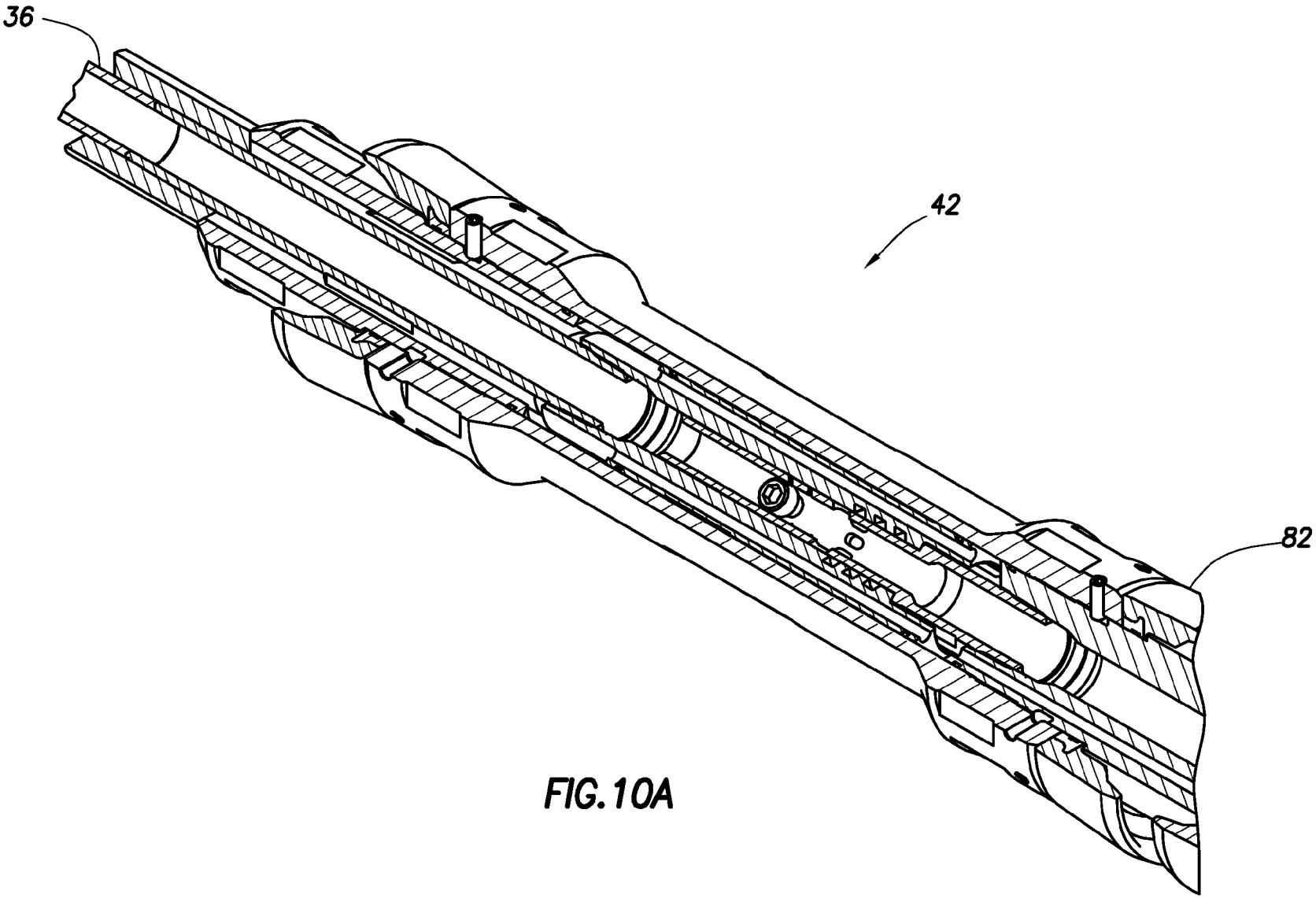
FIGS. 10A-F are enlarged scale representative sectioned perspective views of another example of the injection tool.
Figure 10B:
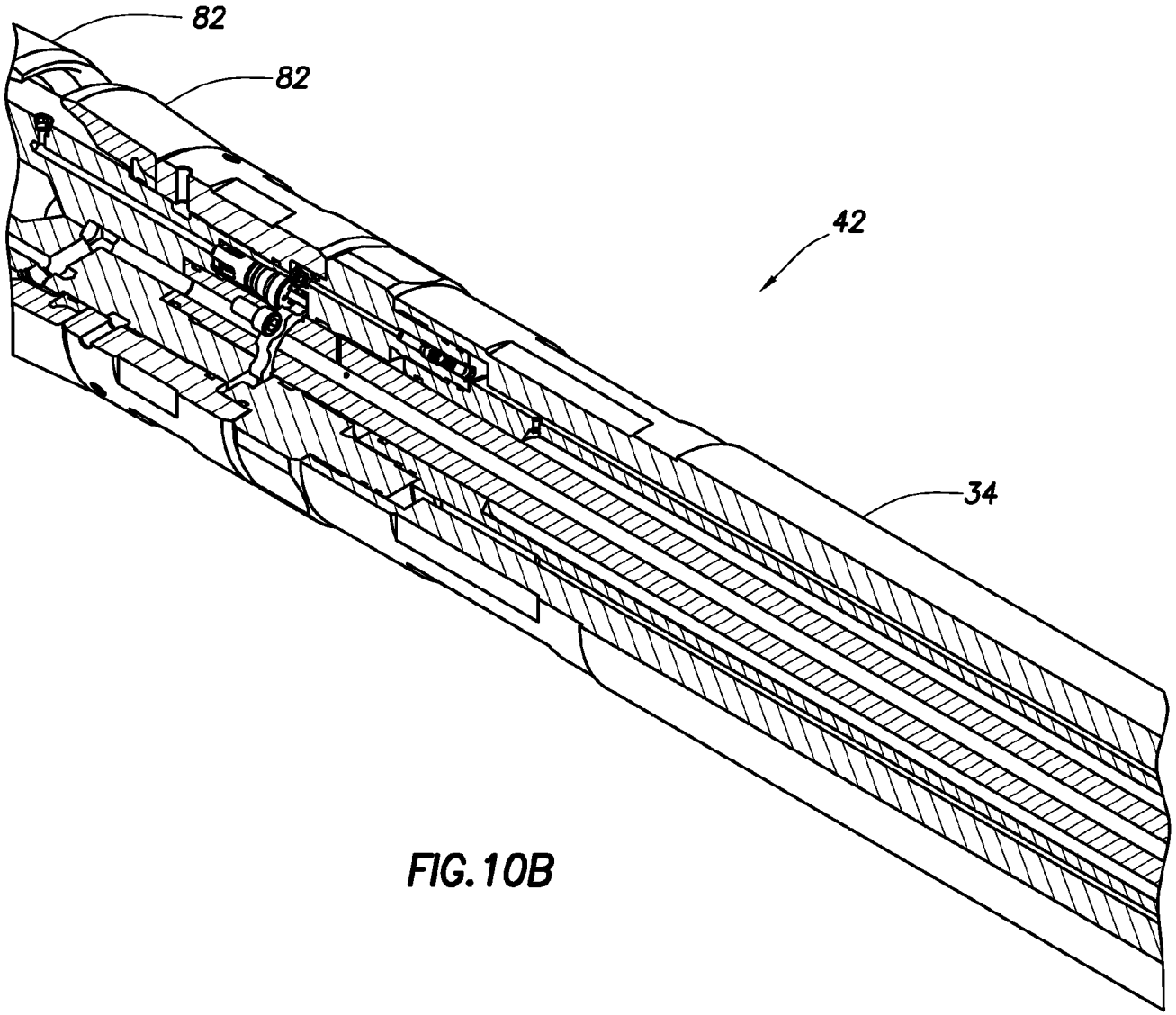
Figure 10C:
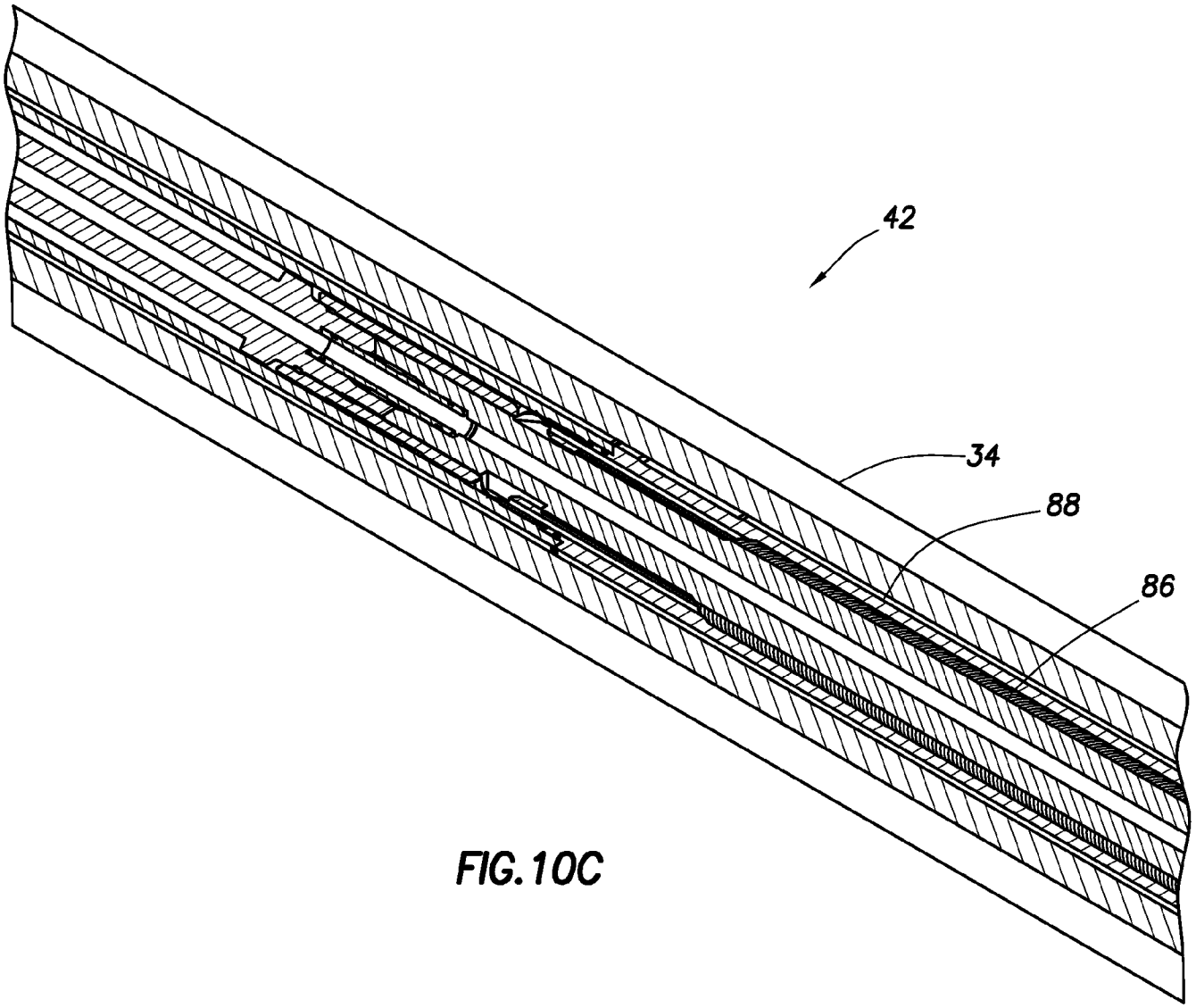
Figure 10D:
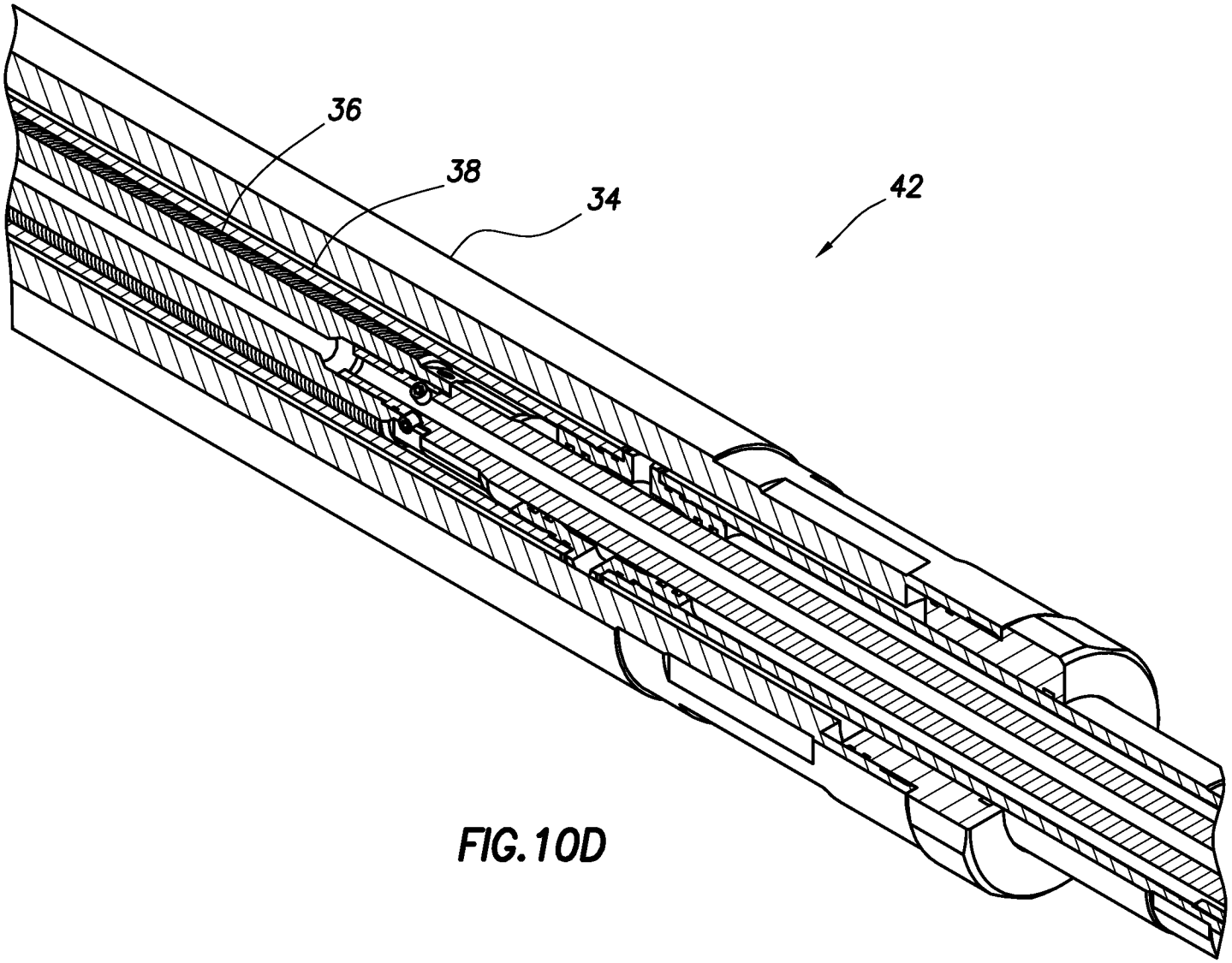
Figure 10E:
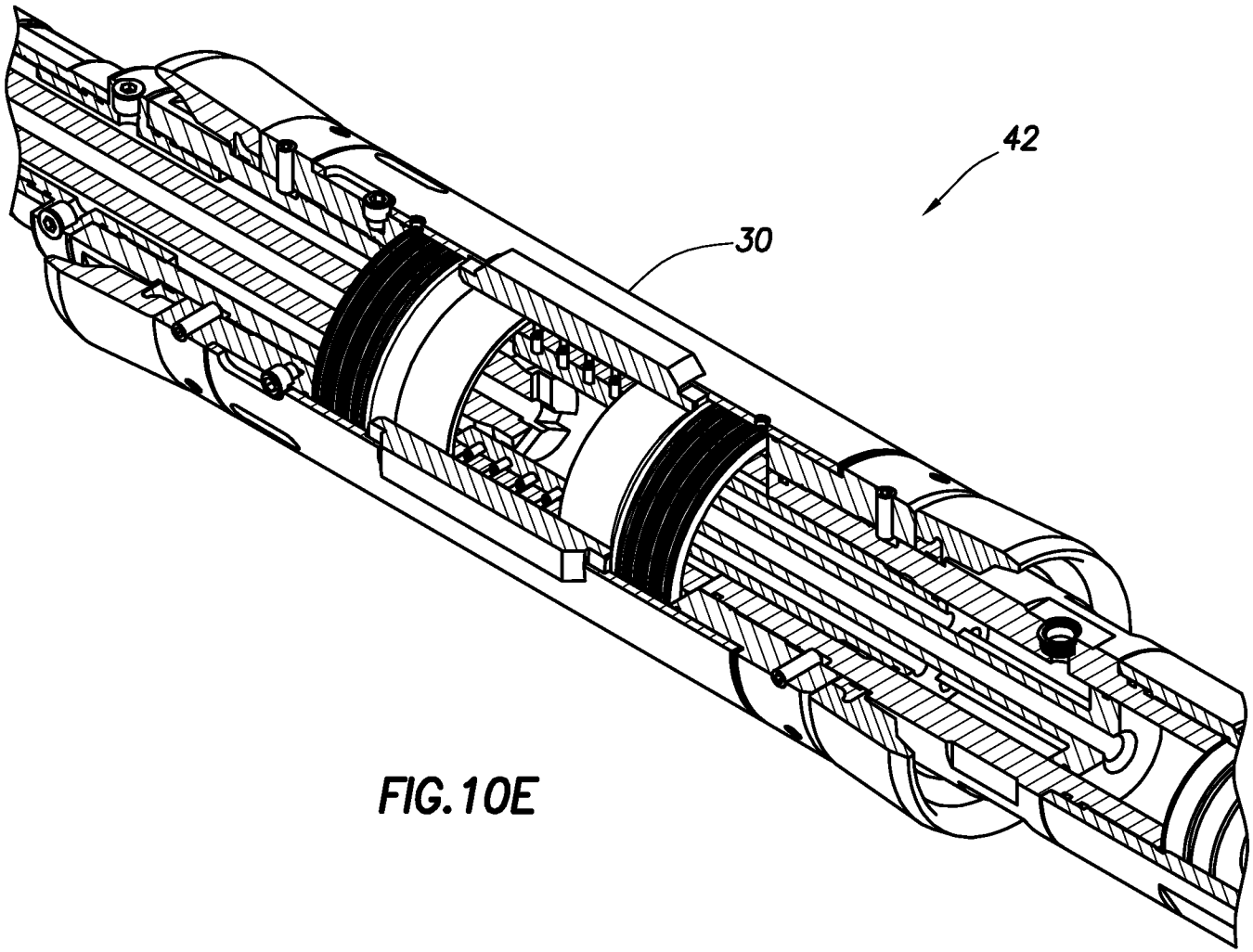
Figure 10F:
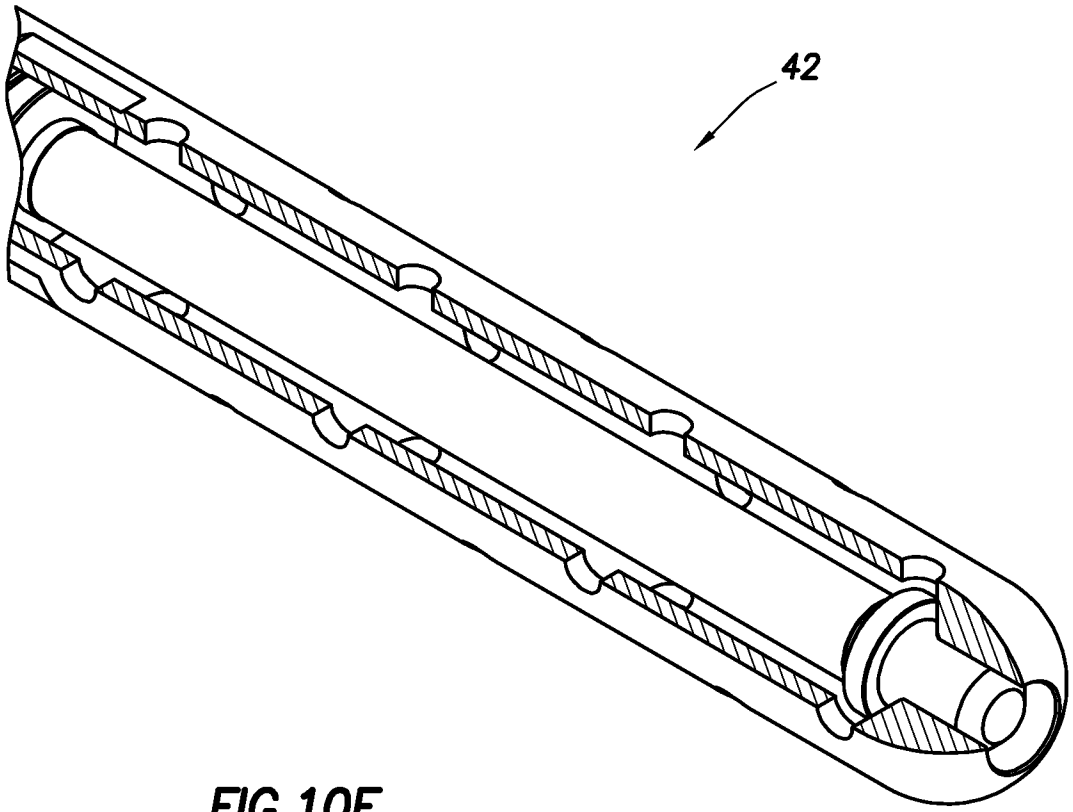

As depicted in FIG. 9A, the pressure intensifier 40 includes a piston 69 having unequal piston diameters 69*a*, 69*b* at opposite ends thereof. By applying pressure to the larger piston diameter 69*a*, increased pressure is generated at the smaller diameter 69*b*.

Increased pressure can be applied to the piston 69 via the tubular string 36 (see FIG. 2) connected to the expansion tool 28, thereby displacing the piston downward and applying further intensified pressure to the interior of the bladder 34. A biasing device 70 (such as a spring, etc.) returns the piston 69 to its initial position when pressure applied to the piston is decreased.

Fluid 72 can be pumped through check valves 74 via a chamber 76 exposed to the smaller piston diameter 69*b*. Note that the pressure intensifier 40 will need to be lowered relative to an outer housing assembly 78 after engaging the latch 30 with the profile 32, in order to align ports in the expansion tool 28 for flow of the fluid 72 from the tubular string 36 to the interior of the bladder 34. In FIGS. 9A-F, the expansion tool 28 is depicted in a run-in or retrieval configuration, in which the interior of the bladder 34 is in communication with a flow passage 80 extending longitudinally in the tool and exposed to ambient pressure in the well.

Thus, in operation, the expansion tool 28 is conveyed into the casing section 16 on the tubular string 36, and the latch 30 is engaged with the profile 32, thereby releasably securing the expansion tool in the casing section and positioning the bladder 34 in the longitudinal portions 44*a-f*, 62*a-f* of the casing section. The tubular string 36 is at this point lowered relative to the housing assembly 78, thereby lowering the pressure intensifier 40, and aligning the ports in the expansion tool, so that pressure applied to the tubular string is communicated to the interior of the bladder 34, thereby inflating the bladder. Pressure in the tubular string 36 can then be alternately increased and decreased, to thereby further increase the pressure applied to the interior of the bladder 34 via the pressure intensifier 40, and expand the casing section 16.

After expansion of the casing section 16, the tubular string 36 can be raised, thereby exposing the interior of the bladder 34 to the passage 80, and allowing the bladder to deflate. The latch 30 can be disengaged from the profile 32 by applying sufficient upward force to the expansion tool 28 via the tubular string 36, to retrieve the expansion tool.

Referring additionally now to FIGS. 10A-F, an enlarged scale sectioned view of another example of the injection tool 42 is representatively illustrated. The injection tool 42 of FIGS. 10A-F differs in several respects from the injection tool example of FIG. 3, at least in part in that a single bladder 34 is used to isolate the openings 20*a-f* from each other in the casing section 16, and the tubular string 36 is selectively and individually placed in communication with each of the openings by rotating the tubular string.

Rotating the tubular string 36 longitudinally displaces annular seals 82 which straddle ports 84 (see FIG. 11) longitudinally spaced apart in the portions 62*a-f* of the inner shell 54 of the casing section 16. Each of the ports 84 is in communication with one of the channels 64*a-f*. Thus, when the seals 82 straddle one of the ports 84, the tubular string 36 is placed in communication with a corresponding one of the channels 64*a-f* which, as described above, is in fluid communication with a corresponding one of the openings 20*a-f* and a corresponding one of the inclusions 12*a,b*.

Therefore, the tubular string 36 can be placed in communication with a selected one of the inclusions 12*a,b* for flowing the fluid 46 into the inclusion and propagating the inclusion further into the formation 14. Rotation of the tubular string 36 produces longitudinal displacement of the seals 82, due to threads 86 which unscrew from a mandrel 88 when the tubular string 36 is rotated.

The bladder 34 is inflated by applying pressure to the interior of the tubular string 36, thereby inflating the bladder. The bladder 34 can have a sealing material (such as an elastomer, etc.) on an outer surface thereof, so that the sealing material seals against the interior surface of the casing section 16.

In this manner, after the bladder 34 is inflated, the openings 20*a-f* are isolated from each other in the casing section 16. Thus, when the tubular string 36 is rotated to place the seals 82 straddling one of the ports 84, the fluid 46 flowed into the corresponding inclusion will not be communicated to any of the other inclusions. As a result, an individual inclusion 12*a,b* can be propagated into the formation 14, with individual control over how that inclusion is propagated.

In actual practice, the injection tool 42 is lowered into the well on the tubular string 36. The latch 30 is engaged with the profile 32 to secure the injection tool 42 relative to the casing section 16.

Pressure is then applied to the tubular string 36 to inflate the bladder 34 and isolate the openings 20*a-f* from each other. The tubular string 36 is then rotated to place the seals 82 straddling a first one of the ports 84 corresponding to a first one of the openings 20*a-f*. Fluid 46 is then pumped from the tubular string 36 to the port 84 between the seals 82, through the respective channel 64*a-f*, through the respective opening 20*a-f*, and then into the respective inclusion 12*a,b*.

Figure 11:
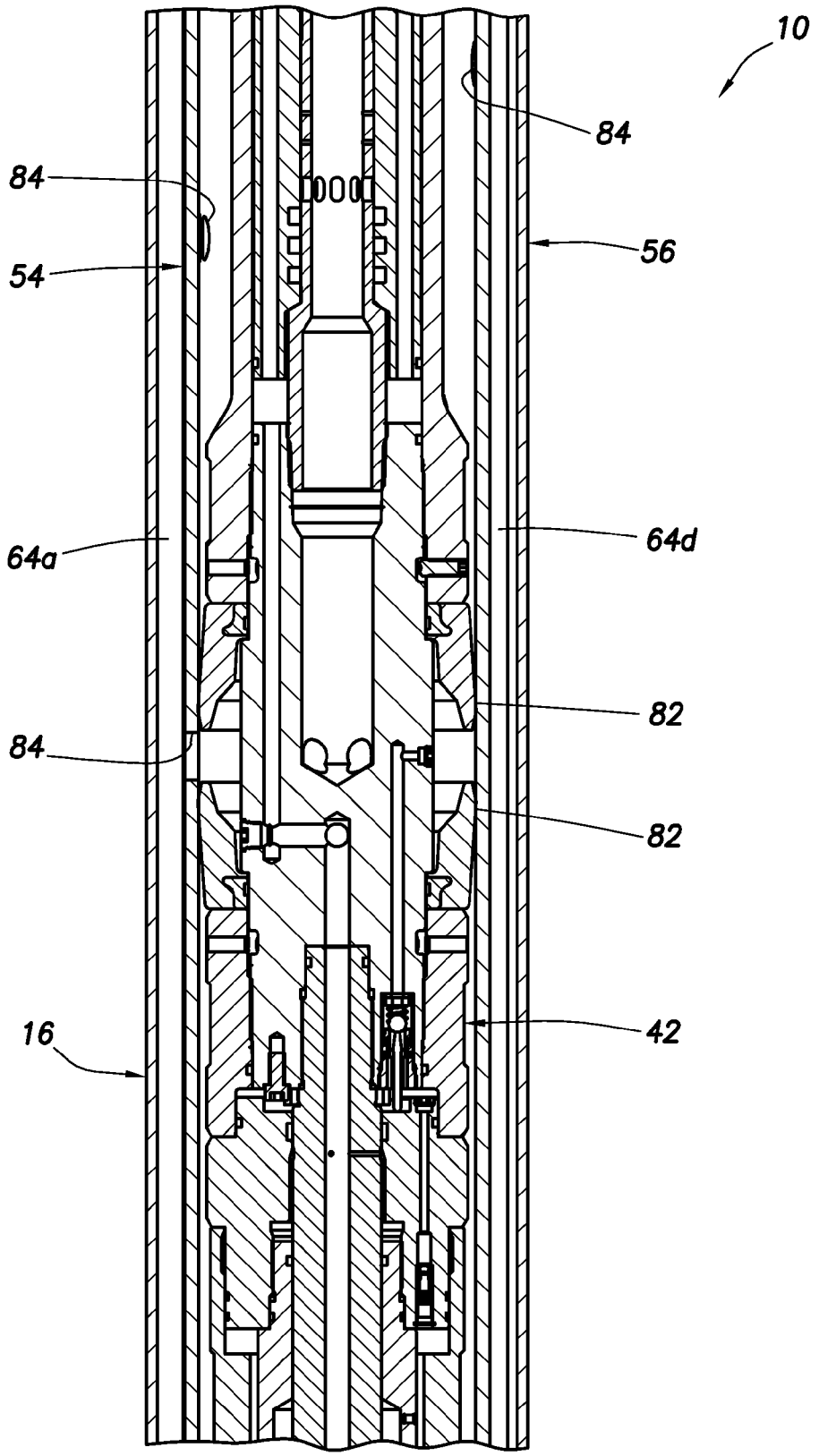
FIG. 11 is a representative cross-sectional view of a portion of the FIGS. 10A-F injection tool installed in the FIGS. 5-8 casing section.

When it is desired to flow the fluid 46 into another inclusion, the tubular string 36 is again rotated to place the seals 82 straddling another of the ports 84. In FIG. 11, the seals 82 are depicted straddling a port 84 extending through one of the inner shell portions 62*a-f*. The port 84 being straddled by the seals 82 is in communication with the channel 64*a*, which is in communication with a respective one of the openings 20*a-f* and inclusions 12*a,b*.

The injection tool 42 examples of FIGS. 3, 4 and 10A-11 beneficially permit reversing out and/or the spotting of treatment fluid down to the conduits 48*a,b* or ports 84. The injection tool 42 is also preferably configured to allow for fluid flow longitudinally through the tool, so that returns can be flowed from another zone through the tool during treatment.

Thus, fluid from multiple treated inclusions can be flowed through the injection tool 42. In one beneficial arrangement, multiple injection tools 42 can be installed in corresponding multiple casing sections 16, and certain azimuthal positions can be selected in each of the casing sections. For example, one injection tool 42 could be positioned to inject fluid into a certain inclusion, and another injection tool could be positioned to produce fluid from another chosen inclusion, with the two inclusions being in the same or different azimuthal orientations. Fluid could be simultaneously produced from one inclusion while fluid is injected into another inclusion in the same azimuthal orientation.

Although the examples as described above utilize the separate expansion tool 28 and injection tool 42, it will be appreciated that it is not necessary to perform the expansion and injection operations in separate trips into the wellbore 18. Instead, the expansion and injection tools 28, 42 could be incorporated into a same tool string to perform the expansion and injection steps in a single trip into the wellbore 18, the expansion and injection tools could be combined into a single tool assembly, etc.

The injection tool 42 may be used to re-treat the inclusions 12*a,b* at a later date (e.g., after the inclusions are initially propagated into the formation 14).

The injection tool 42 can be used to treat any combination of inclusions 12 at any azimuthal orientations relative to the casing section 16 simultaneously, or individually, and in any order. For example, inclusions 12 at azimuthal orientations of 0, 120, 240, 60, 180 and 300 degrees (or at another order of azimuthal orientations of 0, 180, 60, 240, 120 and 300 degrees) could be treated. It is not necessary for the azimuthal orientations to be equally spaced apart, or for there to be any particular number of azimuthal orientations.

It may now be fully appreciated that the disclosure above provides several advancements to the art of forming inclusions into a formation. In some examples described above, the inclusions 12*a,b* can be individually propagated into the formation 14, thereby allowing enhanced control over how the inclusions are formed, etc.

In one aspect, this disclosure describes a method of forming multiple inclusions 12*a,b* into a subterranean formation 14. In one example, the method can include initiating the inclusions 12*a,b* into the formation 14, the inclusions 12*a,b* extending outwardly in respective multiple azimuthal orientations from a casing section 16; and flowing fluid 46 into each of the inclusions 12*a,b* individually, thereby extending the inclusions 12*a,b* into the formation 14 one at a time.

The inclusion initiating can include simultaneously initiating multiple inclusions 12*a,b*.

The inclusion initiating can include circumferentially enlarging the casing section 16. The casing section 16 may be circumferentially enlarged in response to inflating an inflatable bladder 34 within the casing section 16. Circumferentially enlarging the casing section 16 can include widening openings 20*a-f* formed through the casing section 16, the openings 20*a-f* being in communication with the inclusions 12*a,b*.

Inflating the bladder 34 may include applying pressure to a pressure intensifier 40 in communication with the bladder 34.

Flowing the fluid 46 can include flowing the fluid 46 through channels 64*a-f* formed longitudinally through the casing section 16. Each channel 64*a-f* may correspond to a respective one of the inclusions 12*a,b* and/or to a respective one of multiple longitudinally extending openings 20*a-f* formed through a side wall of the casing section 16. The inclusions 12*a,b* may be initiated in response to widening the openings 20*a-f*. The channels 64*a-f* may be disposed radially between inner and outer shells 54, 56 of the casing section 16.

Initiating the inclusions 12*a,b* can include widening multiple openings 20*a-f* formed through a side wall of the casing section 16. Flowing the fluid 46 can include isolating the openings 20*a-f* from each other while fluid 46 is flowed into each inclusion 12*a,b*.

Isolating the openings 20*a-f* may include inflating a bladder 34 in the casing section 16. Isolating the openings 20*a-f* can include inflating multiple longitudinally extending bladders 34*a-c*, each bladder 34*a-c* being positioned between an adjacent pair of the openings 20*a-d*.

A system for initiating inclusions outwardly into a subterranean formation from a wellbore is also described above. In one example, the system 10 can include a casing section 16 having multiple flow channels 64*a-f* therein, each of the flow channels 64*a-f* being in communication with a respective one of multiple openings 20*a-f* formed between adjacent pairs of circumferentially extendable longitudinally extending portions 44*a-f*, 62*a-f* of the casing section 16.

The casing section 16 can also include inner and outer shells 54, 56, with the flow channels 64*a-f* being disposed radially between the inner and outer shells 54, 56.

The system 10 may include longitudinally extending bulkheads 58, 60 which straddle each of the openings 20*a-f*, each channel 64*a-f* being in communication with the respective one of the openings 20*a-f* via a respective one of the bulkheads 60.

The system 10 can include an inflatable bladder 34 which expands the casing section 16 in response to the bladder 34 being inflated. The system 10 can include multiple longitudinally extending bladders 34*a-c*, each of the bladders 34*a-c* being positioned between an adjacent pair of the openings 20*a-d*.

The system 10 can include an inflatable bladder 34 which isolates the openings 20*a-f* from each other in the casing section 16.

The system 10 can include an injection tool 42 which provides selective communication with individual ones of the flow channels 64*a-f*. The injection tool 42 may selectively isolate each of multiple ports 84 formed in the casing section 16, each of the ports 84 being in communication with a respective one of the flow channels 64*a-f*.

Also described above, in one example, is a system 10 for forming multiple inclusions 12*a,b* into a subterranean formation 14 from a wellbore 18. The system 10 in this example can include one or more casing sections 16 and one or more injection tools 42 which engage the casing section 16 and selectively direct fluid 46 into each of the inclusions 12*a,b* individually, whereby the inclusions 12*a,b* are extended into the formation 14 one at a time.

The casing section 16, when circumferentially extended, can initiate the inclusions 12*a,b* into the formation 14, whereby the inclusions 12*a,b* extend outwardly in respective multiple azimuthal orientations from the casing section 16.

The system 10 can include an expansion tool 28 which expands the casing section 16 and thereby simultaneously initiates multiple inclusions 12*a,b*. In other examples, multiple inclusions 12*a,b* may not be simultaneously initiated.

The expansion tool 28 may comprise an inflatable bladder 34. The expansion tool 28 may further comprise a pressure intensifier 40 in communication with the bladder 34.

Openings 20*a-f* in communication with the inclusions 12*a,b* can be widened in response to expansion of the casing section 16.

The casing section 16 may include channels 64*a-f* formed longitudinally through the casing section 16. Each channel 64*a-f* can correspond to a respective one of the inclusions 12*a,b*. Each channel 64*a-f* can correspond to a respective one of multiple longitudinally extending openings 20*a-f* formed through a side wall of the casing section 16. The inclusions 12*a,b* may be initiated in response to the openings 20*a-f* being widened.

The channels 64*a-f* may be disposed radially between inner and outer shells 54, 56 of the casing section 16.

The inclusions 12*a,b* may be initiated in response to multiple openings 20*a-f* formed through a side wall of the casing section 16 being widened. The openings 20*a-f* can be isolated from each other while fluid 46 is flowed into each inclusion 12*a,b*.

The openings 20*a-f* can be isolated from each other by a bladder 34 inflated in the casing section 16. The openings 20*a-f* can be isolated from each other by multiple longitudinally extending bladders 34*a-c*, each bladder 34*a-c* being positioned between an adjacent pair of the openings 20*a-f*.

The at least one casing section 16 may comprise multiple casing sections 16. The at least one injection tool 42 may comprise multiple injection tools 42. A first injection tool 42 can selectively direct fluid into a first inclusion 12, and a second injection tool 42 can selectively produce fluid from a second inclusion 12. The first and second inclusions 12 may be in a same azimuthal orientation. The first injection tool 42 may direct fluid into the first inclusion 12 concurrently as the second injection tool 42 produces fluid from the second inclusion 12.

It is to be understood that the various examples described above may be utilized in various orientations, such as inclined, inverted, horizontal, vertical, etc., and in various configurations, without departing from the principles of this disclosure. The embodiments illustrated in the drawings are depicted and described merely as examples of useful applications of the principles of the disclosure, which are not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of this disclosure. Accordingly, the foregoing detailed description is to be clearly understood as being given by way of illustration and example only, the spirit and scope of the invention being limited solely by the appended claims and their equivalents.

What is claimed is:

1. A system for initiating inclusions outwardly into a subterranean formation from a wellbore, the system comprising:

a casing section having multiple flow channels therein, each of the flow channels being in communication with a respective one of multiple openings formed between adjacent pairs of circumferentially extendable longitudinally extending portions of the casing section;

an expansion tool releasably secured within an interior passage of the casing section, and wherein the expansion tool radially expands the casing section; and an injection tool which provides selective communication with individual ones of the flow channels wherein the injection tool selectively isolates each of multiple ports formed in the casing section, each of the ports being in communication with a respective one of the flow channels.

2. The system of claim 1, wherein the casing section further comprises inner and outer shells, the flow channels being disposed radially between the inner and outer shells.

3. The system of claim 1, further comprising longitudinally extending bulkheads which straddle each of the openings, each channel being in communication with the respective one of the openings via a respective one of the bulkheads.

4. The system of claim 1, further comprising an inflatable bladder which expands the casing section in response to the bladder being inflated.

5. The system of claim 1, further comprising an inflatable bladder which isolates the openings from each other in the casing section.

6. A system for initiating inclusions outwardly into a subterranean formation from a wellbore, the system comprising:

a casing section having multiple flow channels therein, each of the flow channels being in communication with a respective one of multiple openings formed between adjacent pairs of circumferentially extendable longitudinally extending portions of the casing section;

an injection tool which provides selective communication with individual ones of the flow channels, wherein the injection tool selectively isolates each of multiple ports formed in the casing section, each of the ports being in communication with a respective one of the flow channels, wherein only a single one of the inclusions extending radially outwardly in a single direction from the casing section is formed at a time; and multiple longitudinally extending bladders, each of the bladders being positioned between an adjacent pair of the openings.

* * * * *

UNITED STATES PATENT AND TRADEMARK OFFICE

CERTIFICATE OF CORRECTION

PATENT NO. : 8,955,585 B2
APPLICATION NO. : 13/624737
DATED : February 17, 2015
INVENTOR(S) : Travis W. Cavender et al.

It is certified that error appears in the above-identified patent and that said Letters Patent is hereby corrected as shown below:

Title page, insert item 30, "Foreign Application Priority Data" section,
-- 27 September 2011 (WO) ..... PCT/US11/53403 --.

Signed and Sealed this
Twenty-third Day of June, 2015

Michelle K. Lee

Michelle K. Lee
*Director of the United States Patent and Trademark Office*